US006840182B2

(12) United States Patent
Price

(10) Patent No.: US 6,840,182 B2
(45) Date of Patent: Jan. 11, 2005

(54) PORTABLE MODULAR FIELD KITCHEN

(76) Inventor: Roy Justin Price, 1229 E. Gary Cir., Mesa, AZ (US) 85203

( * ) Notice: Subject to any disclaimer, the term of this patent is extended or adjusted under 35 U.S.C. 154(b) by 155 days.

(21) Appl. No.: 10/190,410

(22) Filed: Jul. 2, 2002

(65) Prior Publication Data

US 2004/0004416 A1 Jan. 8, 2004

(51) Int. Cl.[7] ..... A47B 57/00
(52) U.S. Cl. ..... 108/101; 108/118
(58) Field of Search ..... 312/236, 229, 312/297; 108/101, 64, 65, 118, 92, 25, 26, 67, 119, 120, 99; 211/181.1; 160/231.1, 231.2

(56) References Cited

U.S. PATENT DOCUMENTS

| | | | | | |
|---|---|---|---|---|---|
| 458,909 | A | | 9/1891 | Lincoln | |
| 687,250 | A | | 11/1901 | Monfort | |
| 1,057,650 | A | * | 4/1913 | McDevitt | 108/31 |
| 1,730,345 | A | | 10/1929 | Beman | |
| 1,814,692 | A | * | 7/1931 | Harris | 211/123 |
| 1,919,439 | A | | 7/1933 | Little | |
| 1,949,662 | A | * | 3/1934 | Schenk | 108/63 |
| 2,354,941 | A | | 8/1944 | Treitel | |
| 2,460,997 | A | * | 2/1949 | Myers | 211/123 |
| 2,638,394 | A | * | 5/1953 | Ulrich | 108/34 |
| 2,657,737 | A | * | 11/1953 | Kanaval | 248/164 |
| 2,722,972 | A | * | 11/1955 | Altruda | 248/164 |
| 2,806,624 | A | * | 9/1957 | Beckner | 220/6 |
| 2,886,186 | A | | 5/1959 | Hamilton | |
| 2,922,529 | A | | 1/1960 | Culbertson | |
| 2,944,862 | A | | 7/1960 | Heil | |
| 3,100,572 | A | | 8/1963 | Gingher et al. | |
| 3,208,807 | A | | 9/1965 | Becker | |
| 3,215,096 | A | | 11/1965 | Holtz | |
| 3,289,664 | A | | 12/1966 | Hewitt | |
| 3,372,829 | A | * | 3/1968 | Averill | 220/6 |
| 3,663,081 | A | | 5/1972 | Williams | |
| 3,756,680 | A | | 9/1973 | Lerner | |
| 3,811,559 | A | | 5/1974 | Carter | |
| 3,915,529 | A | | 10/1975 | Bernier | |
| 3,998,332 | A | | 12/1976 | Lambertson | |
| 4,092,973 | A | | 6/1978 | Bernazzani | |
| 4,188,890 | A | | 2/1980 | de Villers | |
| 4,251,044 | A | | 2/1981 | Olson | |
| 4,321,873 | A | | 3/1982 | Nealis | |
| 4,334,724 | A | | 6/1982 | Rogers | |
| 4,436,353 | A | | 3/1984 | Tucker | |
| 4,580,750 | A | | 4/1986 | Spellman | |
| 4,645,260 | A | * | 2/1987 | Harty et al. | 297/35 |
| D291,047 | S | | 7/1987 | Pappas | |
| 4,934,280 | A | | 6/1990 | Bae | |
| 5,213,221 | A | * | 5/1993 | Raye, Sr. | 211/195 |
| 5,645,259 | A | | 7/1997 | Chen | |
| 5,884,566 | A | * | 3/1999 | Chen | 108/67 |
| 5,913,270 | A | * | 6/1999 | Price | 108/101 |
| 6,024,024 | A | * | 2/2000 | Favaretto | 108/64 |
| 6,073,894 | A | * | 6/2000 | Chen | 248/165 |
| 6,367,393 | B1 | * | 4/2002 | Kasten | 108/153.1 |
| 2002/0060510 | A1 | * | 5/2002 | Choi | 312/6 |

FOREIGN PATENT DOCUMENTS

| | | | | |
|---|---|---|---|---|
| DE | 617895 | | 8/1935 | |
| GB | 2202139 A | * | 9/1988 | D06F/57/08 |

* cited by examiner

*Primary Examiner*—Janet M. Wilkens
(74) *Attorney, Agent, or Firm*—Lewis Brisbois Bisgaard & Smith LLP

(57) ABSTRACT

A portable modular field kitchen for use in the out-of-doors comprises a main frame having at least a pair of scissors support legs interconnected with at least a pair of vertical upright members for providing a scissors operator. Each of the scissors support legs comprises a front support leg and a rear support leg interconnected to provide a scissors action. The scissors support legs are interconnected by a pair of parallel top support members for providing stability, and each of the vertical upright members is pivotally joined to the corresponding front support leg. A top work surface is removably attached to each of the parallel top support members. A collapsible upper frame section is supported by the vertical upright members for suspending a plurality of cooking articles. Finally, at least one side grate table having a collapsible frame is releasably attached to the main frame.

19 Claims, 16 Drawing Sheets

PORTABLE MODULAR FIELD KITCHEN

BACKGROUND OF THE INVENTION

1. Technical Field

The present invention relates to the preparation and serving of food in the out-of-doors. More specifically, the present invention relates to methods and apparatus for a portable modular field kitchen for use with other cooking equipment in preparing and serving food at campsites, backyard patios and other outdoor venues.

2. Background Art

The relevant art is directed to outdoor kitchen type devices. The outdoor kitchen type devices of the prior art are typically employed for (a) storing food stuffs transported to an outdoor site, and for (b) food preparation. The outdoor site can be a campsite for hunting, fishing, hiking, rock climbing, a roadside camping facility for recreational vehicles or any other outdoor activity typically removed from ones residence. In the alternative, the outdoor site can be as local as a barbecue grill located at a city park, the beach or even on the patio or in the back yard of ones residence.

An outdoor field kitchen device known in the prior art includes a structure having a top work surface and storage shelves. The field kitchen device is formed entirely from steel tubing and consequently is very heavy, cumbersome and unstable. Thus, the field kitchen device is difficult for a woman or small person to transport, assemble and disassemble. Another kitchen type device or campers table includes a top work surface comprised of polyethylene which can be removed and replaced with a sink or a portable stove of the type used in a recreational vehicle or tent trailer. Several other outdoor kitchen type devices include a work surface and a sink mounted adjacent to the work surface. Draining water from the sink after use is accomplished by a drain hole which often results in creating a pool of water underneath the outdoor kitchen device. Further, the sink is very shallow and consequently is not useful for washing large utensils. Additionally, the outdoor kitchen device is expensive and generally unstable.

Several other outdoor kitchen type devices have been known in the prior art and have been referred to as a compact portable kitchen, kitchen unit, camp stove cabinet, compact field kitchen, field range cabinet, portable storage device table, foldable sink table, compact portable kitchen and the like.

The prior art compact portable kitchen is contained within a box and, when assembled, stands on four legs and includes multiple shelves and storage areas, a work surface and a cooler box. When disassembled, the compact portable kitchen box fits into a standard trailer or the back of a station wagon.

The prior art kitchen unit includes the main kitchen features, i.e., a sink, a stove unit located within a counter top, an icebox and a dish rack located within a cabinet for outdoor use. Water is pumped by pressure out of a faucet and a separate bottle collects drain water. The stove utilizes butane gas from a portable container for fuel and the icebox utilizes stored ice as a cooling medium.

The prior art camp stove cabinet comprises a cabinet having a top surface that serves to support a portable gas stove powered by a bottled flammable gas. The top surface also serves as a work surface. A pair of multiple tier cabinets having hinged doors are located underneath the top surface.

The prior art compact field kitchen is also box-shaped and stands upon four legs when assembled. The main portion of the field kitchen includes a sink and a stove fueled by a bottled flammable gas. A vertical portion includes a plurality of storage cabinets and a direct current source is employed to power a fluorescent lamp. When disassembled, the entire field kitchen collapses into a portable box.

The prior art field range cabinet is a portable out-of-doors cooking apparatus having a removable outer shell. The outer shell is capable of easy and quick locking and unlocking with respect to the frame of the field range cabinet and easy removal from the frame to facilitate cleaning of the interior walls. The interior of the field range cabinet also includes horizontal and vertical support elements of the frame for enclosing the contents of what is being cooked.

The prior art portable storage device and table for use in outdoor activities unfolds from a trunk-like container into a table. The storage device and table has a front shelf space which foldably lifts from the container for providing support for the table surface. The trunk-like base provides a storage receptacle for articles.

The prior art foldable sink table includes a top work surface located adjacent to a sink. The sink table includes four vertical legs including a storage space underneath the work surface. Mounted above the work surface are shelves and mounted adjacent to the sink table is another large work surface.

Finally, the prior art compact portable kitchen includes a box-shaped apparatus on wheels having an upper surface completely covered by multiple cooking devices such as a range, a grill and a deep pan fryer. Beneath the top surface is a storage drawer and underneath the drawer is a storage shelf. Mounted above the top surface is a hood including a ventilation fan. The compact portable kitchen clearly requires a source of electricity to power the cooking apparatus.

Thus, there is a need in the art for a portable modular field kitchen that comprises a lightweight, robust aluminum frame, which is assembled and disassembled quickly and easily without the use of tools, includes a removable main work surface that is located at standard counter top height, includes a side table located at a suitable height for accommodating the serving of meals and the support of cooking equipment where the side table has a top surface comprised of a wire grate for allowing spillage to escape, includes a pair of lantern holders, and the collapsed modular field kitchen is insertable into a waterproof carrying case.

DISCLOSURE OF THE INVENTION

Briefly, and in general terms, the present invention provides a new and improved portable modular field kitchen for use with other cooking equipment in preparing and serving food at campsites, backyard patios and other outdoor venues. The inventive portable modular field kitchen exhibits a robust lightweight design including an aluminum main frame, a removable top work surface, a collapsible upper frame section, and at least one side grate table.

The field kitchen is modular in nature in that the elements are comprised of uniform standard components designed for use with others of its kind. For example, any component can be separated from the field kitchen and replaced with a duplicate component which will operate just as the replaced component. As an example, the components of the main frame are connected together and operate as a unit. However, the main frame as a unit is easily separated from other components, such as the removable top work surface, upper frame section and the side grate table also included in the field kitchen. The field kitchen is easily assembled for use and easily disassembled and collapsed since tools are not required.

In a preferred embodiment of the present invention, the main frame includes at least a pair of scissors support legs interconnected with at least a pair of vertical upright members. The combination of the scissors support legs and the vertical upright members functions as a scissors operator. Further, each of the scissors support legs includes a front support leg and a rear support leg also interconnected to provide a scissors action. The front support leg comprises a first leg section connected to a second leg section and to the rear support leg with a pair of offset hinges for enabling the front support leg to fold flat onto the rear support leg. Each of the vertical upright members is pivotally joined to the corresponding front support leg, and the scissors support legs are also interconnected by a pair of parallel top support members for providing stability. Further, each of the scissors support legs and each of the corresponding vertical upright members collapse and fold onto the parallel top support members.

The top work surface is removably mounted to the parallel top support members of the main frame with a plurality of plastic retainer clips and is positioned at standard counter top height above the ground level to facilitate food preparation. The top work surface is comprised of a plurality of aluminum slats connected together by at least one elastic cord. Further, the side grate table is positioned at a height above ground level to facilitate eating meals. The side grate table includes a collapsible frame and is removably attached to the main frame. The side grate table further includes a wire grate top surface for allowing spilled items to fall through to the ground. The collapsible upper frame section comprises a pair of mid-vertical sections supported by the corresponding pair of vertical upright members. The upper frame section includes a cross arm comprising a plurality of hooks for suspending cooking articles, and a pair of lantern holders for positioning lanterns above the top work surface. When disassembled and collapsed, the field kitchen is transported and stored in a convenient carrying enclosure.

The present invention is generally directed to a portable modular field kitchen for use in preparing and serving food in the out-of-doors typically employed at, for example, campsites, roadside camping facilities for recreational vehicles, at a city park, the beach or even on the patio or in the back yard of a residence or other outdoor venue. In its most fundamental embodiment, the portable modular field kitchen comprises a main frame having at least a pair of scissors support legs interconnected with at least a pair of vertical upright members for providing a scissors operator. Each of the scissors support legs comprises a front support leg and a rear support leg interconnected to provide a scissors action. The scissors support legs are interconnected by a pair of parallel top support members for providing stability, and each of the vertical upright members is pivotally joined to the corresponding front support leg. A top work surface is removably attached to each of the parallel top support members for providing a food preparation surface. A collapsible upper frame section is supported by the vertical upright members for suspending a plurality of cooking articles above the top work surface. Finally, at least one side grate table having a collapsible frame and being releasably attached to the main frame is provided.

These and other objects and advantages of the present invention will become apparent from the following more detailed description, taken in conjunction with the accompanying drawings which illustrate the invention, by way of example.

DESCRIPTION OF THE PREFERRED EMBODIMENTS

Figure 1:
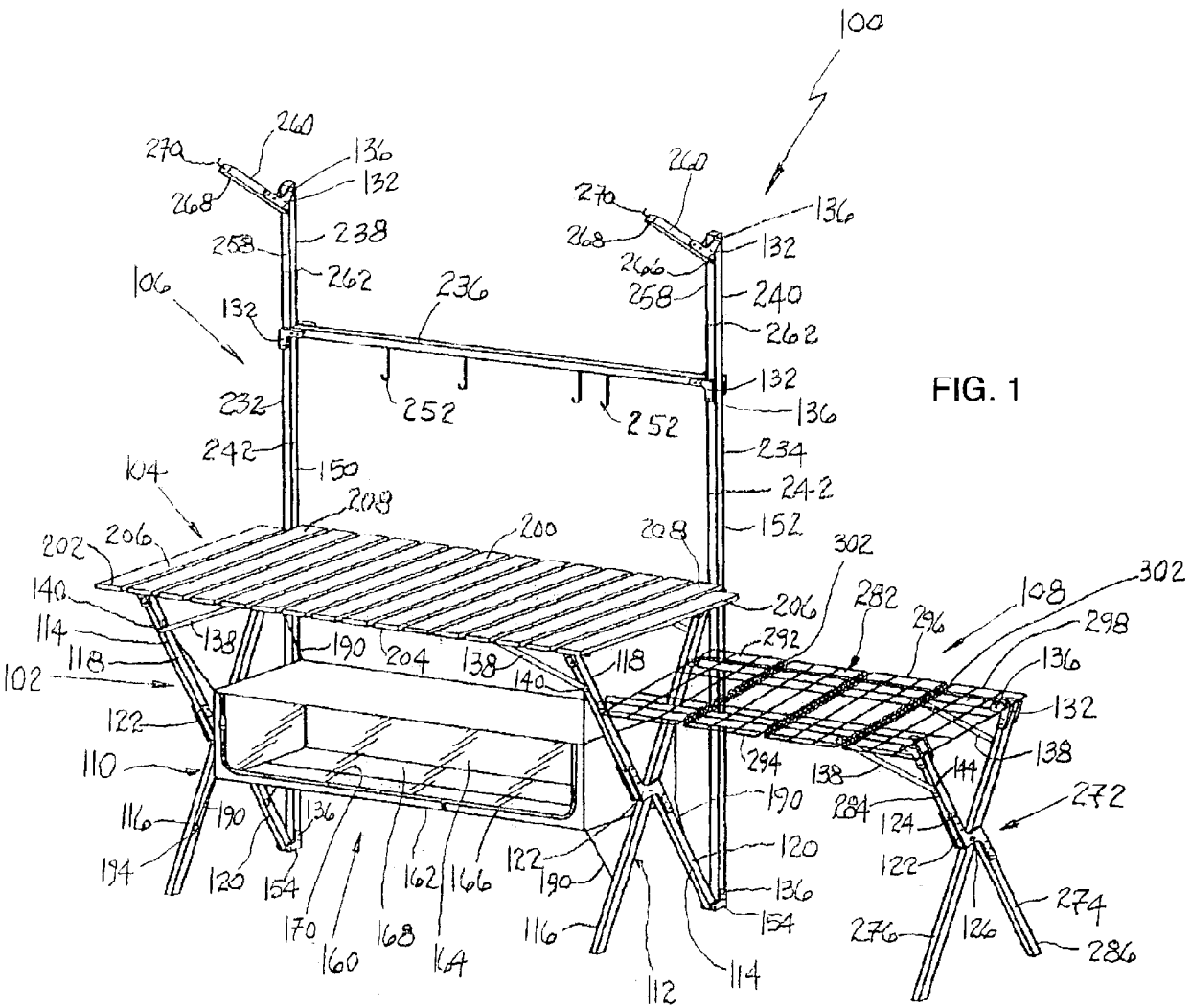
FIG. 1 is a perspective view of a portable modular field kitchen having a main frame with a removable top work surface, a bag pantry for storing kitchen wears, a superstructure having a cross arm for suspending kitchen articles and a pair of lantern holders, and an auxiliary side table.

The present invention is a portable modular field kitchen 100 as best shown in FIG. 1 for use in preparing and serving food in the out-of-doors. The field kitchen 100 of the present invention serves as an outdoor kitchen organizer by providing a situs to organize and utilize cooking utensils and equipment (including cooking equipment) for the storing, preparing and serving of food. The portable modular field kitchen 100 is typically employed at camp sights, roadside camping facilities for recreational vehicles, at a city park, beach or even on a patio or in a back yard of a residence or other outdoor venue.

A preferred embodiment of the portable modular field kitchen 100 is shown in FIGS. 1–36 and comprises four main categories including a collapsible main frame 102, a removable top work surface 104, a collapsible upper frame section 106, and at least one side grate table 108. A description of the components of each of these four main categories will now be set out in successive order. It is noted that the portable modular field kitchen 100 exhibits a robust lightweight tubular design structure comprised of aluminum. However, other lightweight, high-strength materials can be utilized. It is further noted that the aluminum tubular structure is preferably eight-sided as shown in FIG. 13, however, the field kitchen 100 can also be fashioned from other multi-sided tubing that is not eight-sided. Eight-sided aluminum tubing is preferred because multiple flat surfaces are conveniently available for affixing the removable top work surface 104 to the main frame 102 as will be discussed in more detail herein below.

It is noted that the field kitchen is modular in nature in that the elements are comprised of uniform standard components designed for use with the other components of the portable modular field kitchen 100. For example, any component of the field kitchen 100 can be separated from the field kitchen 100 and replaced with a duplicate component which will operate just as the replaced component. To further the example, the components of the main frame 102 are connected together and operate as a singular unit. However, the main frame 102 as a unit is easily separated from other components, such as the removable top work surface 104, collapsible upper frame section 106, and the side grate table 108 also included in the field kitchen 100. Further, the field kitchen 100 is easily assembled for use and easily disassembled and collapsed since tools are not required.

Figure 2:
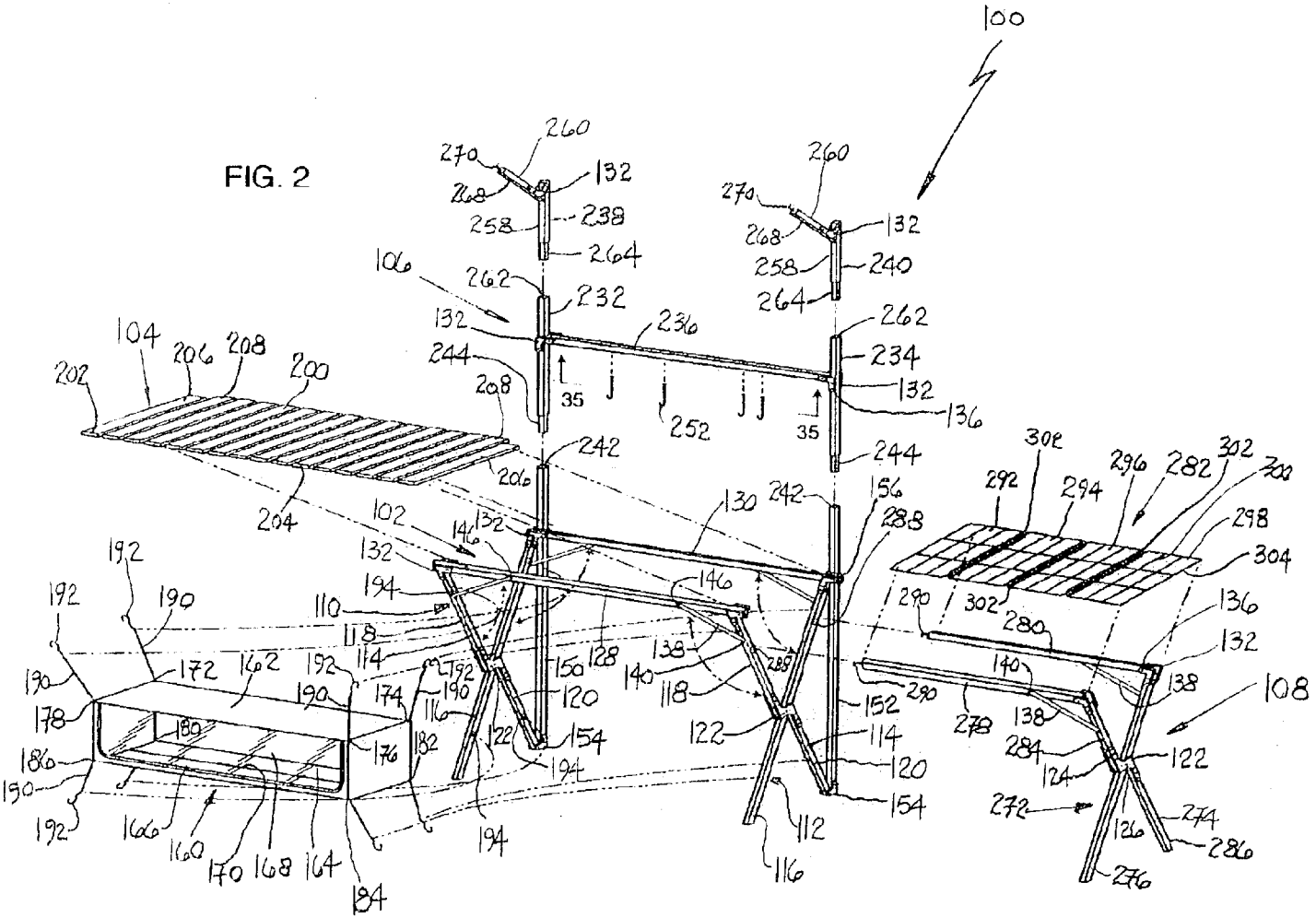
FIG. 2 is an exploded perspective view of the portable modular field kitchen of FIG. 1 showing the main frame, removable top work surface, bag pantry, superstructure exhibiting the cross arm and lantern holders, and auxiliary side table.
Figure 3:
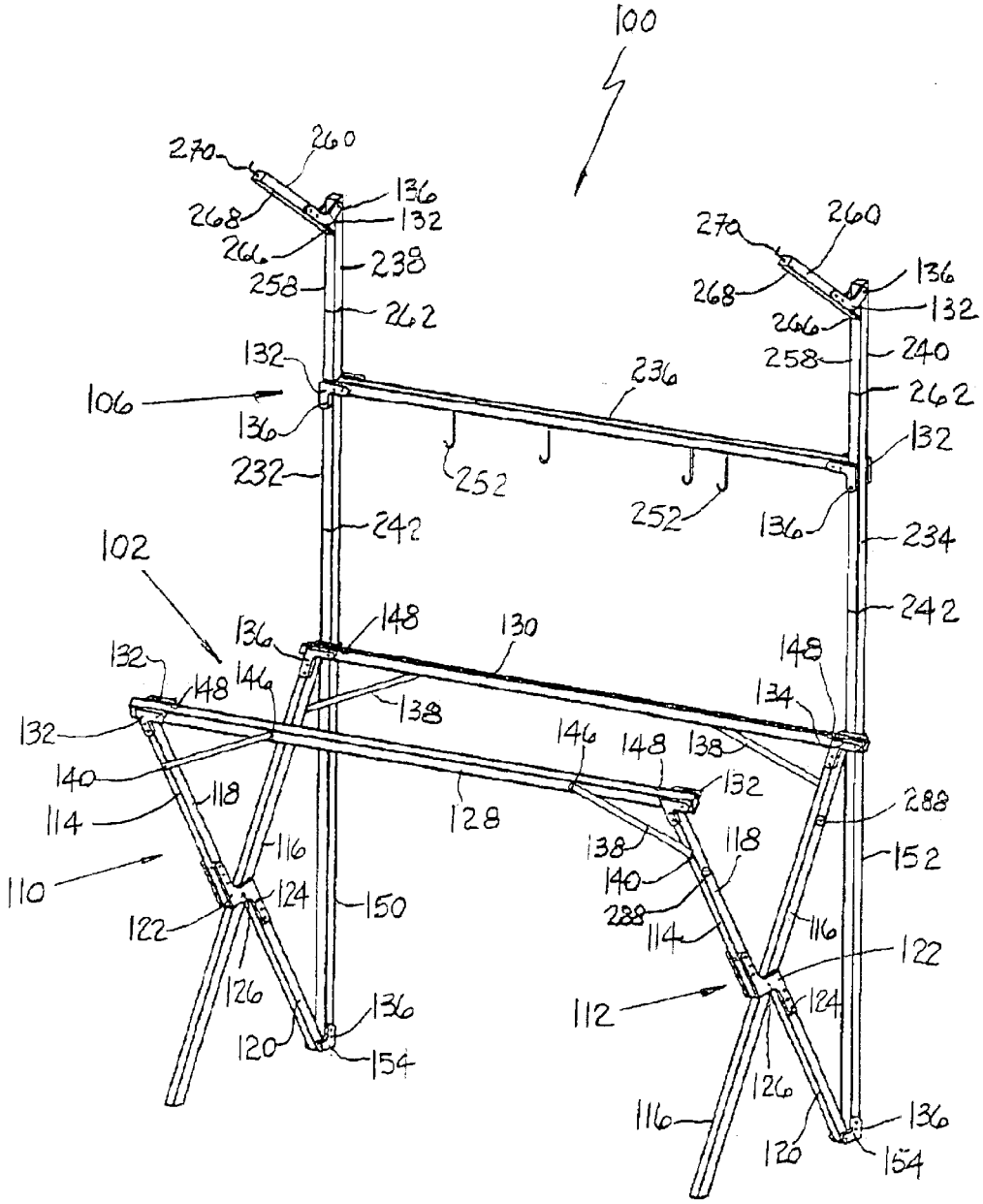
FIG. 3 is a perspective view showing the main frame including an offset hinge, a pair of vertical upright members, a pair of mid-vertical sections for supporting the cross arm, and the pair of lantern holders of the portable modular field kitchen of FIG. 1.
Figure 10:
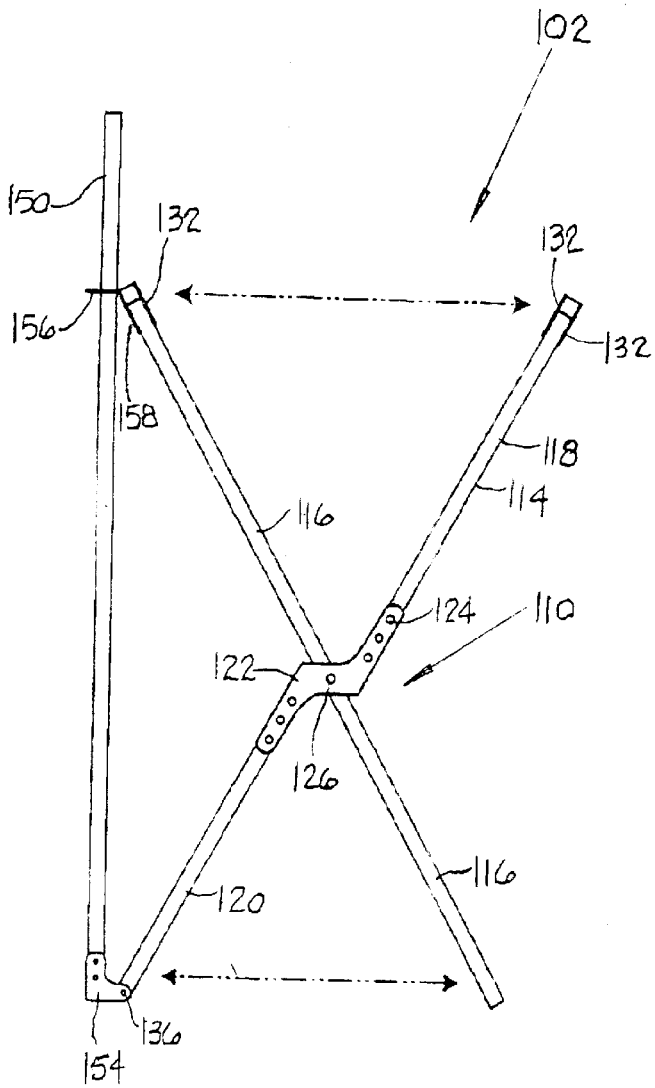
FIG. 10 is a side elevation of the main frame including one of the pair of offset hinges, and one of the pair of vertical upright members of the portable modular field kitchen of FIG. 1.

Referring now to the first category of the preferred embodiment, the main frame 102 is clearly shown in FIGS. 1 and 2 but is best shown in FIG. 3 in conjunction with the collapsible upper frame section 106. The function of the main frame 102 is to provide the support for a plurality of working and storage surfaces that will be described in more detail herein below. The main frame 102 in its most fundamental simplified form comprises at least a pair of scissors support legs including a first scissors support leg 110 and a second scissors support leg 112 as shown in FIGS. 1–3. Each of the scissors support legs 110 and 112 actually comprise a set of a front support leg 114 and a rear support leg 116 interconnected to provide a scissors action. Further, the front support leg 114 is formed of a first leg section 118 and a second leg section 120. It is noted that the first leg section 118 is rigidly connected to the second leg section 120 by a pair of offset hinges 122 and a plurality of mechanical fasteners 124 such as, for example, rivets, best shown in FIGS. 3 and 10. The pair of offset hinges 122 (which connect the first leg section 118 to the second leg section 120 of the front support leg 114) is also connected to the rear support leg 116. The rear support leg 116 is comprised of a single unitary eight-sided tube of aluminum. A mechanical fastener 126 serves as a pivot point at the intersection of the rear support leg 116 and the pair of offset hinges 122 as shown in FIGS. 3 and 10. The mechanical fastener 126 can also be, for example, a rivet or other suitable fastener.

Figure 4:
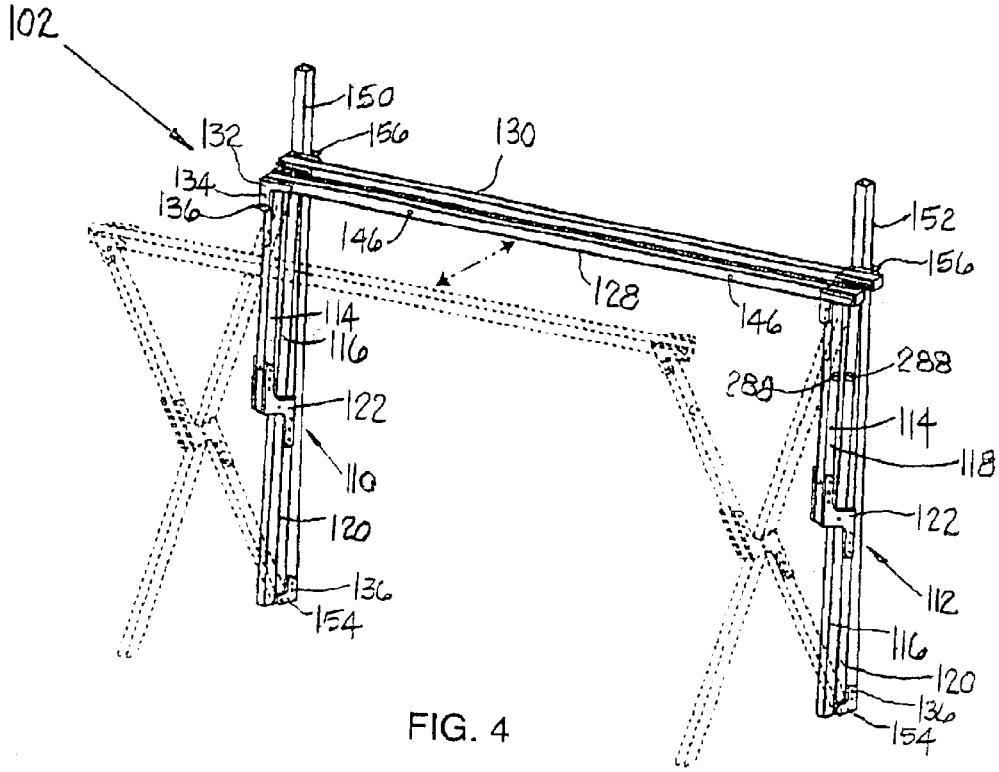
FIG. 4 is a perspective view of the main frame (in phantom) in the expanded position, and the main frame and pair of vertical upright members in the partially collapsed position of the portable modular field kitchen of FIG. 1 with a double-headed arrow illustrating the direction of movement between the expanded and partially collapsed positions.
Figure 5:
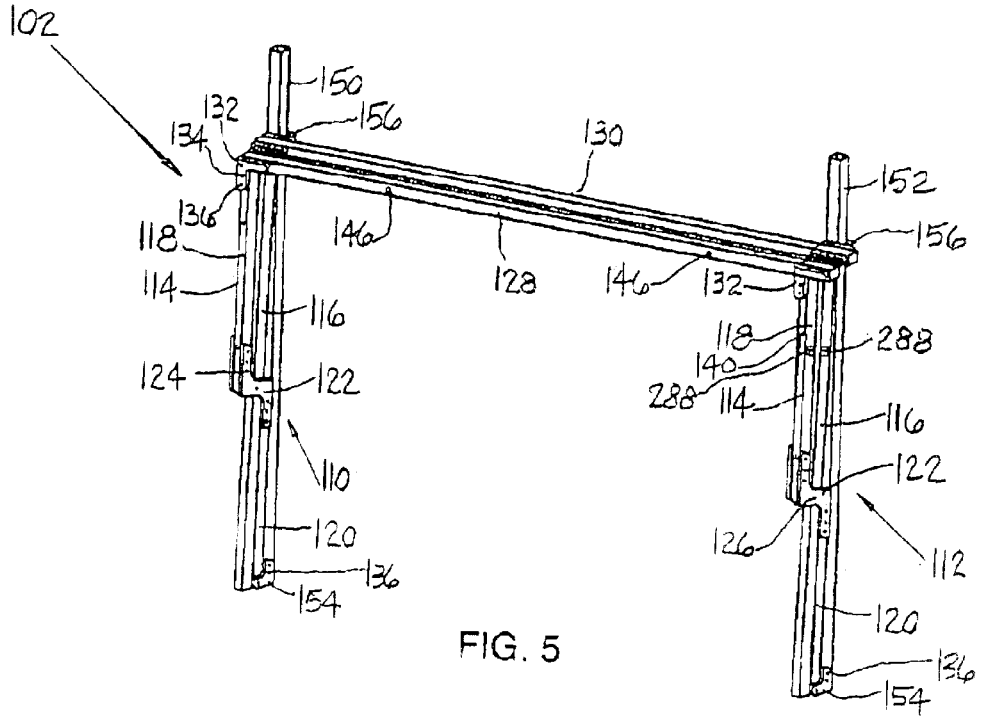
FIG. 5 is a perspective view showing the main frame, offset hinges, and the pair of vertical upright members in the partially collapsed position of the portable modular field kitchen of FIG. 1.
Figure 7:
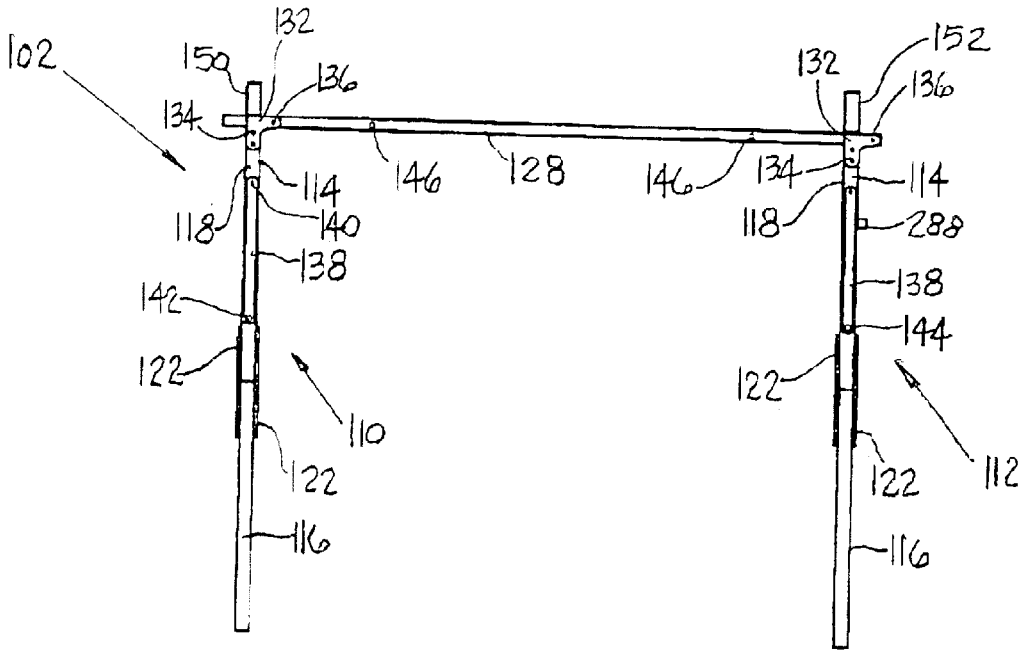
FIG. 7 is a front elevation of the main frame including the pair of offset hinges, and the pair of vertical upright members of the portable modular field kitchen of FIG. 6.
Figure 8:
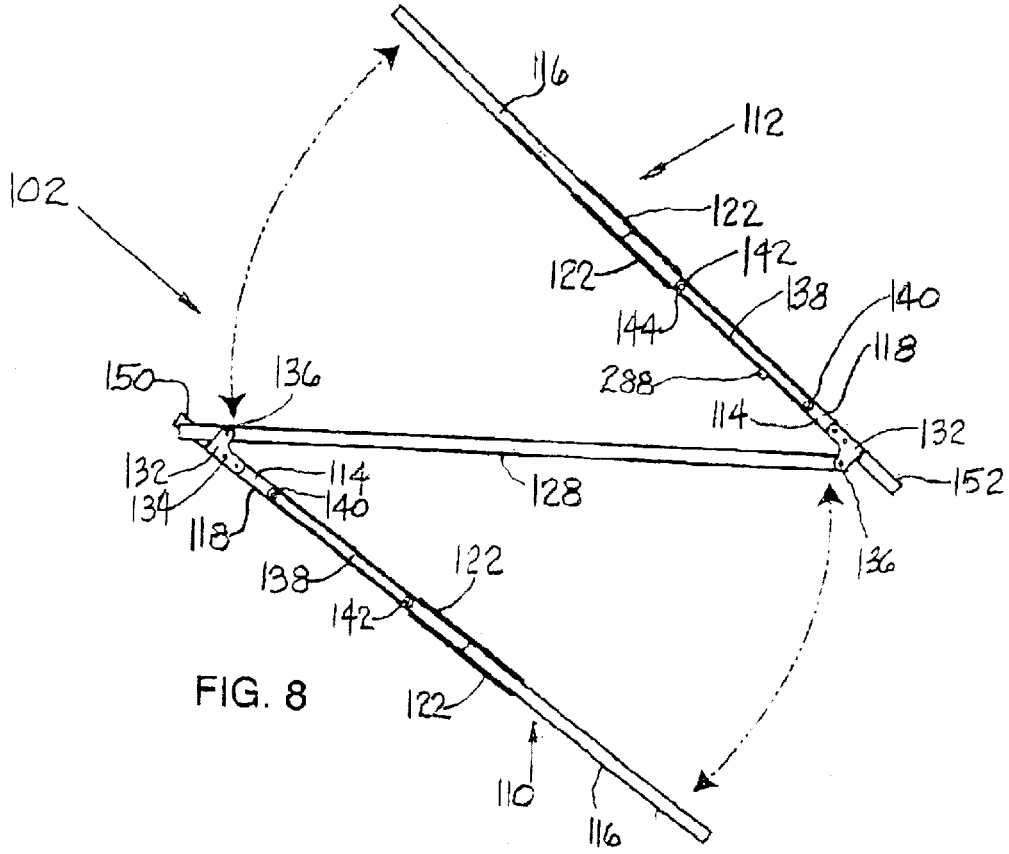
FIG. 8 is a front elevation of the main frame including the pair of offset hinges, and the pair of vertical upright members of the portable modular field kitchen of FIG. 7 showing the support leg sets being rotated to achieve the fully collapsed position.
Figure 9:
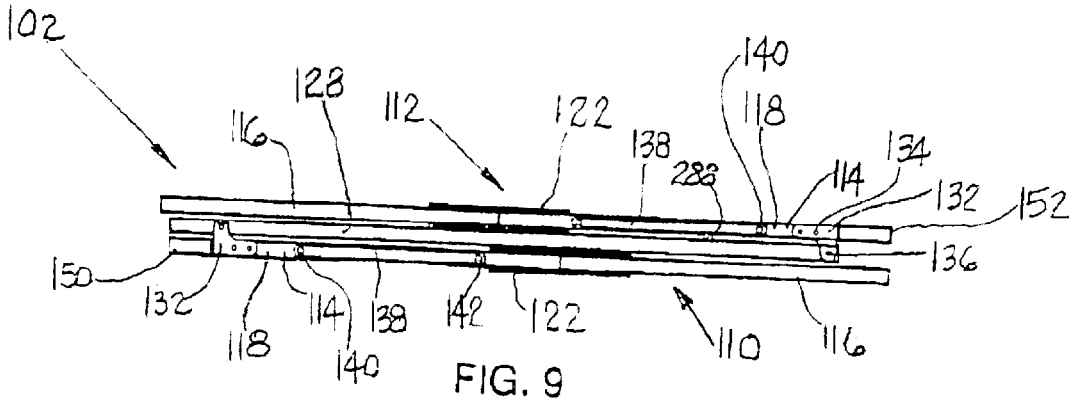
FIG. 9 is the main frame including the pair of offset hinges, and the pair of vertical upright members of the portable modular field kitchen of FIG. 6 shown in the fully collapsed position.
Figure 11:
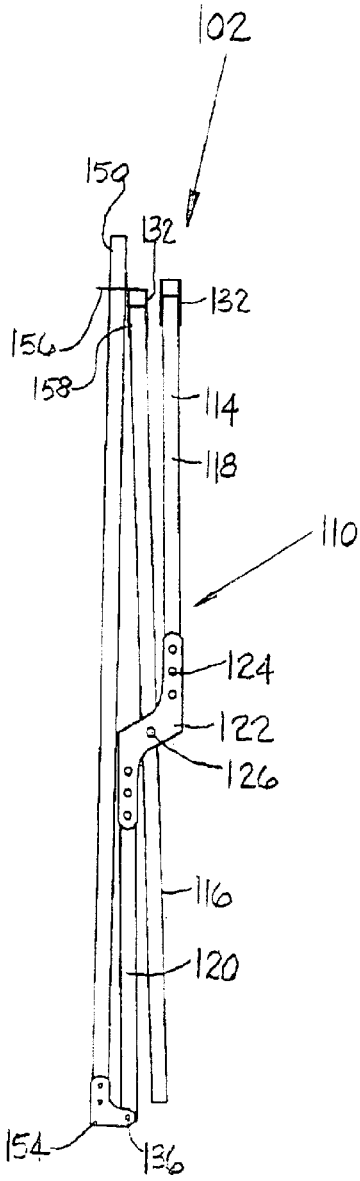
FIG. 11 is a side elevation of the main frame including one of the pair of offset hinges, and one of the pair of vertical upright members of the portable modular field kitchen of FIG. 1 shown in the partially collapsed position.

Each of the scissors support legs 110 and 112 employs the use of two of the offset hinges 122, i.e., one on each side of each of the scissors support legs 110 and 112, as shown best in FIGS. 7, 8 and 9. In order to cause the modular field kitchen 100 to collapse into a convenient size to maximize portability, it is desirable that the front support leg 114 fold flat onto the rear support leg 116. In order to arrange that the front support leg 114 fold flat onto the rear support leg 116, the legs must be offset. This offset feature is provided by the offset hinges 122 as shown clearly in FIG. 10. The hinges 122 serve to offset the front support leg 114 and the rear support leg 116 of each of the scissors support legs 110 and 112. As a result, the front support leg 114 is capable of folding flat onto the rear support leg 116 as is illustrated in FIGS. 4, 5 and 11 of the accompanying drawings.

The scissors support legs 110 and 112 are interconnected by a pair of parallel top support members comprising a first top support member 128 and a second top support member 130 for providing stability to the main frame 102. The parallel top support members 128 and 130 are clearly shown in FIGS. 2, 3, 4, 5, 6, 7, and 8. The first top support member 128 and the second top support member 130 are preferably fashioned from eight-sided aluminum tubing. The first top support member 128 of the main frame 102 is connected between the first leg section 118 of the front support leg 114 of the first scissors support leg 110 and the first leg section 118 of the front support leg 114 of the second scissors support leg 112. Likewise, the second top support member 130 of the main frame 102 is connected between the rear support leg 116 of the first scissors support leg 110 and the rear support leg 116 of the second scissors support leg 112. Each of these connections between the first top support member 128 and the first leg section 118 of each of the corresponding front support legs 114 of each of the scissors support legs 110 and 112 is accomplished by employing two of a plurality of angle brackets 132 best shown in FIG. 3. Likewise, each of these connections between the second top support member 130 and the corresponding rear support legs 116 of each of the scissors support legs 110 and 112 is also accomplished by employing two of the plurality of angle brackets 132 also best shown in FIG. 3.

Each of the angle brackets 132 is typically comprised of aluminum and includes a plurality of penetrations 134 (preferably three) for receiving an equal plurality of fasteners 136 such as, for example, rivets. The angle brackets 132 and the fasteners 136 are employed to rigidly retain the first top support member 128 to (a) the top of the first leg section 118 of the corresponding front support leg 114 of the first scissors support leg 110 and (b) the top of the first leg section 118 of the corresponding front support leg 114 of the second scissors support leg 112. Likewise, the angle brackets 132 and the fasteners 136 are also employed to rigidly retain the second top support member 130 to (c) the top of the rear support leg 116 of the first scissors support leg 110 and (d) the top of the rear support leg 116 of the second scissors support leg 112. The main frame 102 also includes a plurality of support rods 138 which are shown engaged in FIGS. 1–3. Each of the support rods 138 (minimum of four) of the main frame 102 are hinged from (1) the first leg section 118 of the front support leg 114 of the first scissors support leg 110, (2) the first leg section 118 of the front support leg 114 of the second scissors support leg 112, (3) the rear support leg 116 of the first scissors support leg 110, and (4) the rear support leg 116 of the second scissors support leg 112.

Each of the support rods 138 is hinged from one of a plurality of fasteners 140 such as, for example, rivets so that each support rod 138 can be rotated from a non-engaged position to an engaged position located on one of the parallel top support members 128 or 130. When non-engaged, i.e., in a non-supporting position, each support rod 138 is rotated or pivoted from one of the fasteners 140 to one of a plurality of resting studs 142 best shown in FIGS. 7, 8 and 9. The resting studs 142 are located on each of (1) the first leg section 118 of the front support leg 114 of the first scissors support leg 110, (2) the first leg section 118 of the front support leg 114 of the second scissors support leg 112, (3) the rear support leg 116 of the first scissors support leg 110, and (4) the rear support leg 116 of the second scissors support leg 112. Each of these locations correspond to one of the fasteners 140 as is shown in FIG. 7. Each of the support rods 138 includes a hook 144 located at the end thereof for attaching to the corresponding resting stud 142. When engaged, i.e., in a supporting position, each of the support rods 138 is rotated or pivoted from one of the fasteners 140 to one of a plurality of support studs 146 best shown in FIGS. 4–7 but also shown in FIGS. 2 and 3. Two of the support studs 146 are located on each of (1) the first top support member 128, and (2) the second top support member 130 as is best shown in FIGS. 3 and 7. Once the hook 144 located on the end of each of the support rods 138 is attached to the corresponding support stud 146, the main frame 102 is reinforced. To disengage, each support rod 138 is merely removed from the corresponding support stud 146 located on one of the top support members 128 or130 and rotated or pivoted about the corresponding fastener 140 for repositioning on the corresponding resting stud 142.

Each of the top support members 128 and 130 is preferably comprised of eight-sided aluminum tubing. Eight-sided tubing can be generated by shaving each corner vertex of conventional square aluminum tubing. The multiple sides of the eight-sided tubing provides a flat surface for spreading the removable top work surface 104 thereon. Further, each of the upper flat surfaces of the eight-sided tubing that comprises the top support members 128 and 130 includes at least a pair of penetrations 148 as shown in FIG. 3 which will cooperate with the securing means utilized to retain the top work surface 104 in place on the main frame 102. This feature will be discussed in more detail with reference to FIGS. 3 and 13 herein below.

The main frame 102 also includes at least a pair of vertical upright members including a first vertical upright member 150 and a second vertical upright member 152 as is clearly shown in FIGS. 2 and 3 but also shown in FIGS. 1, 4–7, 10 and 12. The pair of vertical upright members 150 and 152 are interconnected with the pair of scissors support legs 110 and 112, and it is noted that this combination functions as a scissors operator. It is noted that each of the vertical upright members 150 and 152 is pivotally joined to the corresponding front support leg 114. In particular, the second leg section 120 of the front support leg 114 of the first scissors support leg 110 is mechanically connected to the bottom of the first vertical upright member 150 with a pair of base pivot hinge brackets 154 as is shown in FIGS. 1–6, 10 and 12. The base pivot hinge brackets 154 are utilized in pairs, i.e., one on each side of the intersection of the second leg section 120 of the front support leg 114 and the first vertical upright member 150. Each of the base pivot hinge brackets 154 includes an L-shaped aluminum structure having three penetrations (not shown) formed therein. Two of the penetrations in the hinge bracket 154 align with corresponding penetrations formed in the first vertical upright member 150, and the third penetration in the hinge bracket 154 is aligned with a corresponding penetration formed in the second leg section 120. Each of the penetrations carries one of the plurality of mechanical fasteners 136 as is best shown in FIG. 3. This construction enables the second leg section 120 of the first scissors support leg 110 to rotate with respect to the first vertical upright member 150 when the front support leg 114 and the rear support leg 116 of the first scissors support leg 110 are operated to provide scissors action as shown in FIGS. 4 and 5.

Likewise, the second vertical upright member 152 is pivotally joined to the corresponding front support leg 114. In particular, the second leg section 120 of the front support leg 114 of the second scissors support leg 112 is mechanically connected to the bottom of the second vertical upright member 152 with a duplicate pair of base pivot hinge brackets 154 shown in FIGS. 1–6, 10 and 12. One base pivot hinge bracket 154 is utilized on each side of the intersection of the second leg section 120 of the front support leg 114 of the second scissors support leg 112 and the second vertical upright member 152. Two of the three penetrations formed in the hinge bracket 154 align with corresponding penetrations formed in the second vertical upright member 152, and the third penetration in the hinge bracket 154 is aligned with a corresponding penetration formed in the second leg section 120 of the second scissors support leg 112. Each of the penetrations carries one of the plurality of mechanical fasteners 136 as is best shown in FIG. 3. The second leg section 120 of the second scissors support leg 112 is enabled to rotate with respect to the second vertical upright member 152 when the front support leg 114 and the rear support leg 116 of the second scissors support leg 112 are operated to provide scissors action as shown in FIGS. 4 and 5.

Figure 12:
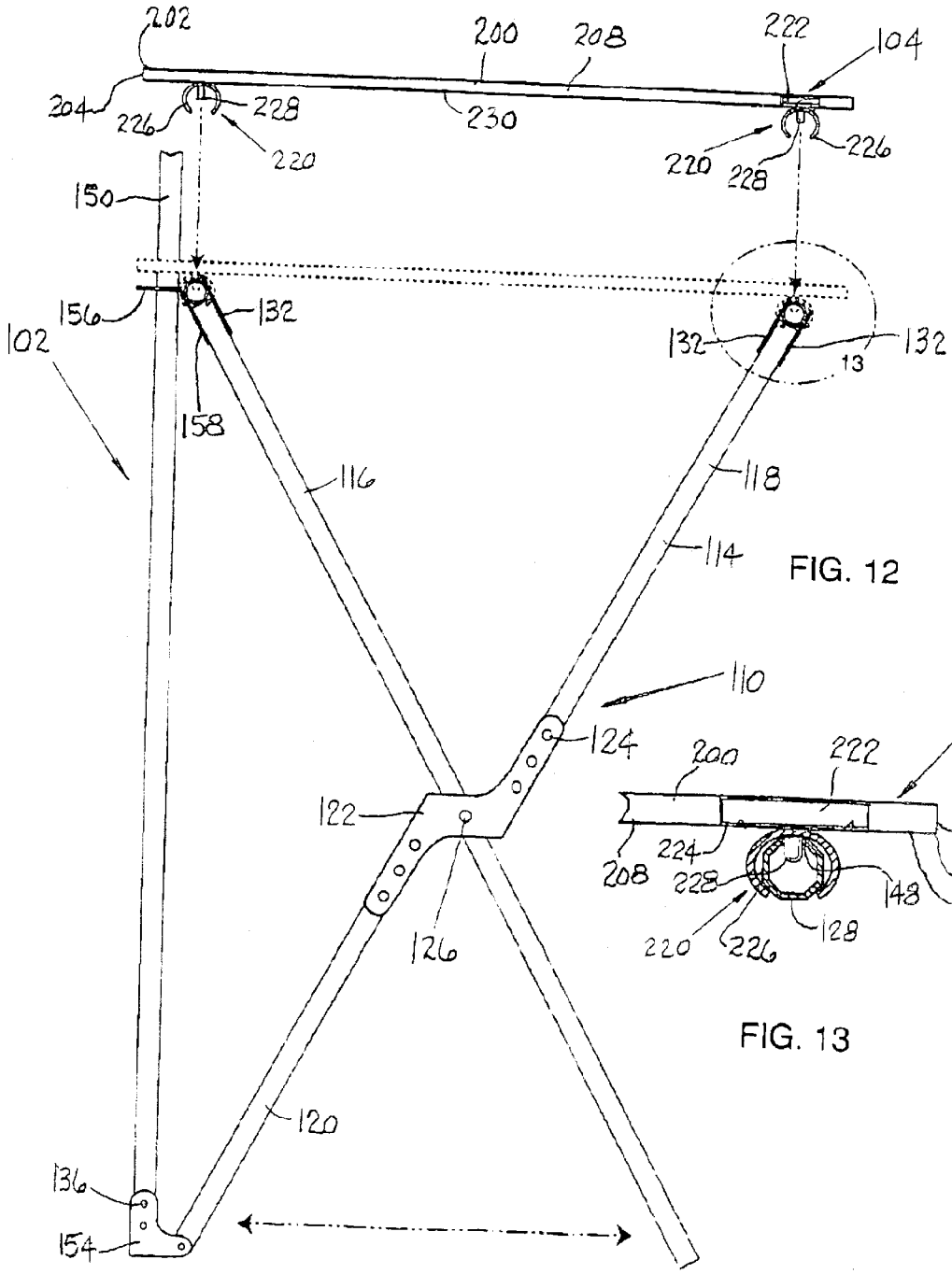
FIG. 12 is a side elevation of the main frame including one of the pair of offset hinges, and one of the pair of vertical upright members of the portable modular field kitchen of FIG. 1 showing one of the two opposite next-to-the-end slats of the removable top work surface positioned above the main frame.
Figure 13:
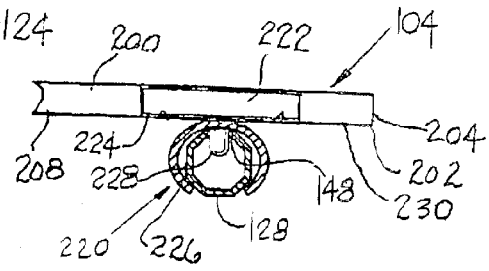
FIG. 13 is a side elevation of a plastic retainer clip having an alignment pin of the portable modular field kitchen of FIG. 1, the retainer clip secured within the two opposite next-to-the-end slats of the removable top work surface, the alignment pin positioned within a penetration formed within the tubing of the main frame.

The intersection of the rear support leg 116 of the first scissors support leg 110 with the second parallel top support member 130 is also moveably attached to the first vertical upright member 150 via one of a pair of guide brackets 156 as shown in FIGS. 4, 5, 6, 10, 11, and 12. Note that the guide bracket 156 located on the upper end of the rear support leg 116 of the first scissors support leg 110 is employed for (a) enabling the first scissors support leg 110 to ride along the vertical length of the first vertical upright member 150 (when the front support leg 114 and the rear support leg 116 of the first scissors support leg 110 are operated to provide scissors action as shown in FIGS. 4 and 5), as well as (b) securing the second parallel top support member 130 to the top of the rear support leg 116 of the first scissors support leg 110 as is best shown in FIGS. 10 and 12. Each of the guide brackets 156 includes a plate 158 (see FIGS. 10 and 12) having a construction very similar to the aluminum angular brackets 132 previously described. The plate 158 of each of the guide brackets 156 includes three penetrations and a corresponding number of fasteners (such as rivets) duplicate to those described with respect to the aluminum angular brackets 132 shown in FIG. 3. The penetrations and fasteners are intended to secure the plate 158 to the side of the rear support leg 116 facing the first vertical upright member 150. However, each guide bracket 156 is generally rectangular-shaped for loosely capturing the corresponding vertical upright member 150.

The intersection of the rear support leg 116 of the second scissors support leg 112 with the second parallel top support member 130 is also moveably attached to the second vertical upright member 152 via the second of the pair of guide brackets 156 as shown in FIGS. 4, 5, 6, 10, 11, and 12. Note that the guide bracket 156 located on the upper end of the rear support leg 116 of the second scissors support leg 112 is also employed for (a) enabling the second scissors support leg 112 to ride along the vertical length of the second vertical upright member 152 (when the front support leg 114 and the rear support leg 116 of the second scissors support leg 112 are operated to provide scissors action as shown in FIGS. 4 and 5), as well as (b) securing the second parallel top support member 130 to the top of the rear support leg 116 of the second scissors support leg 112 as is best shown in FIGS. 10 and 12. The second of the guide brackets 156 also includes a (second) plate 158 (see FIGS. 10 and 12) having a construction duplicate to that described in the immediate previous paragraph, i.e., very similar to the aluminum angular brackets 132 previously described. The plate 158 of each of the guide brackets 156 includes three penetrations and a corresponding number of fasteners (such as rivets) duplicate to those described with respect to the aluminum angular brackets 132 shown in FIG. 3. The penetrations and fasteners are intended to secure the (second) plate 158 to the side of the rear support leg 116 facing the second vertical upright member 152. However, each guide bracket 156 is generally rectangular-shaped for loosely capturing the corresponding vertical upright member 152.

Figure 6:
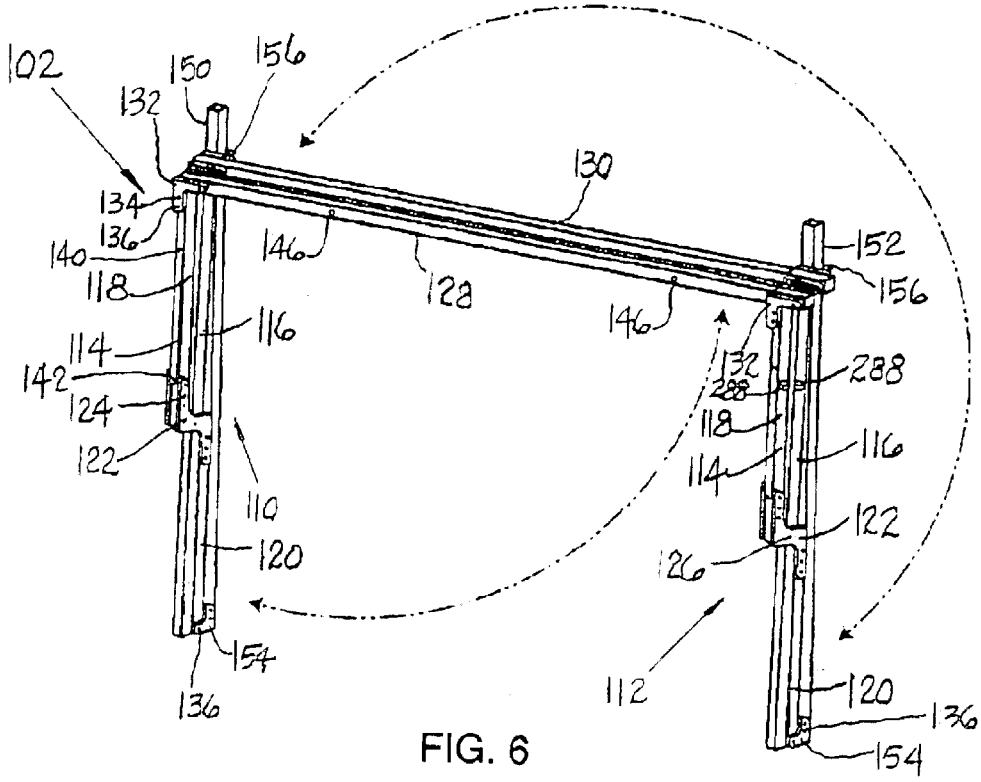
FIG. 6 is a perspective view of the main frame, offset hinges, and pair of vertical upright members of the portable modular field kitchen of FIG. 1 illustrating the movement of components to achieve the fully collapsed position.

The main frame 102 is shown being manipulated into the partially collapsed position in FIG. 4, i.e., when the front support leg 114 and the rear support leg 116 of both the first scissors support leg 110 and the second scissors support leg 112 are operated to provide scissors action. In FIG. 4, the phantom portion of the drawing illustrates the main frame 102 in the expanded position and that portion of the drawing of FIG. 4 in solid lines illustrates the main frame 102 in the partially collapsed position. The partially collapsed position of the main frame 102 (also shown in FIGS. 5, 6 and 7) must be assumed prior to manipulating the main frame 102 into the fully collapsed position. Once the main frame 102 has assumed the partially collapsed position, the front support leg 114 is enabled to fold flat onto the rear support leg 116 of the first scissors support leg 110 via the first of the offset hinges 122. Further, the front support leg 114 and the rear support leg 116 is folded flat against the first vertical upright member 150 as shown in FIGS. 5 and 6. Likewise, in the partially collapsed position, the front support leg 114 is enabled to fold flat onto the rear support leg 116 of the second scissors support leg 112 via the second of the offset hinges 122. In like manner, the front support leg 114 and the rear support leg 116 is folded flat against the second vertical upright member 152 also shown in FIGS. 5 and 6.

The main frame 102 is shown being manipulated into the fully collapsed position in FIGS. 6 and 8 while FIG. 9 shows the main frame 102 in the fully collapsed position. It is the pairs of the aluminum angular brackets 132 that (a) connect the first leg section 118 of the front support leg 114 to the first top support member 128 in both the first scissors support leg 110 and the second scissors support leg 112, and (b) connect the rear support leg 116 to the second top support member 130 in both the first scissors support leg 110 and the second scissors support leg 112. The pairs of aluminum brackets 132 shown in FIGS. 6–9 employ the fasteners 136 (rivets) that pass through the corresponding penetrations 134 in the angular brackets 132 to secure the components of the first and second scissors support legs 110 and 112 to the first and second parallel top support members 128, 130, respectively.

It is noted that the particular fastener (rivet) 136 that secures each angular bracket 132 to the first top support member 128 or to the second top support member 130 serves as a pivot point as is clearly shown in FIG. 8. Thus, the front support leg 114 and the rear support leg 116 that are folded flat against the first vertical upright member 150 can be pivoted from the normal position shown in FIG. 6 to the bottom of the parallel top support members 128, 130 as shown by the dotted arrows in FIGS. 6 and 8. Likewise, the front support leg 114 and the rear support leg 116 that are folded flat against the second vertical upright member 152 can be pivoted from the normal position shown in FIG. 6 to the top of the parallel top support members 128, 130 as shown by the dotted arrows in FIGS. 6 and 8. Upon completion of this folding exercise, the main frame 102 assumes the fully collapsed position as is shown in FIG. 9 and can be installed into a convenience carrying container for easy transport. Upon reversal of this procedure, the main frame 102 can be returned to the partially collapsed position shown in FIG. 6.

Figure 30:
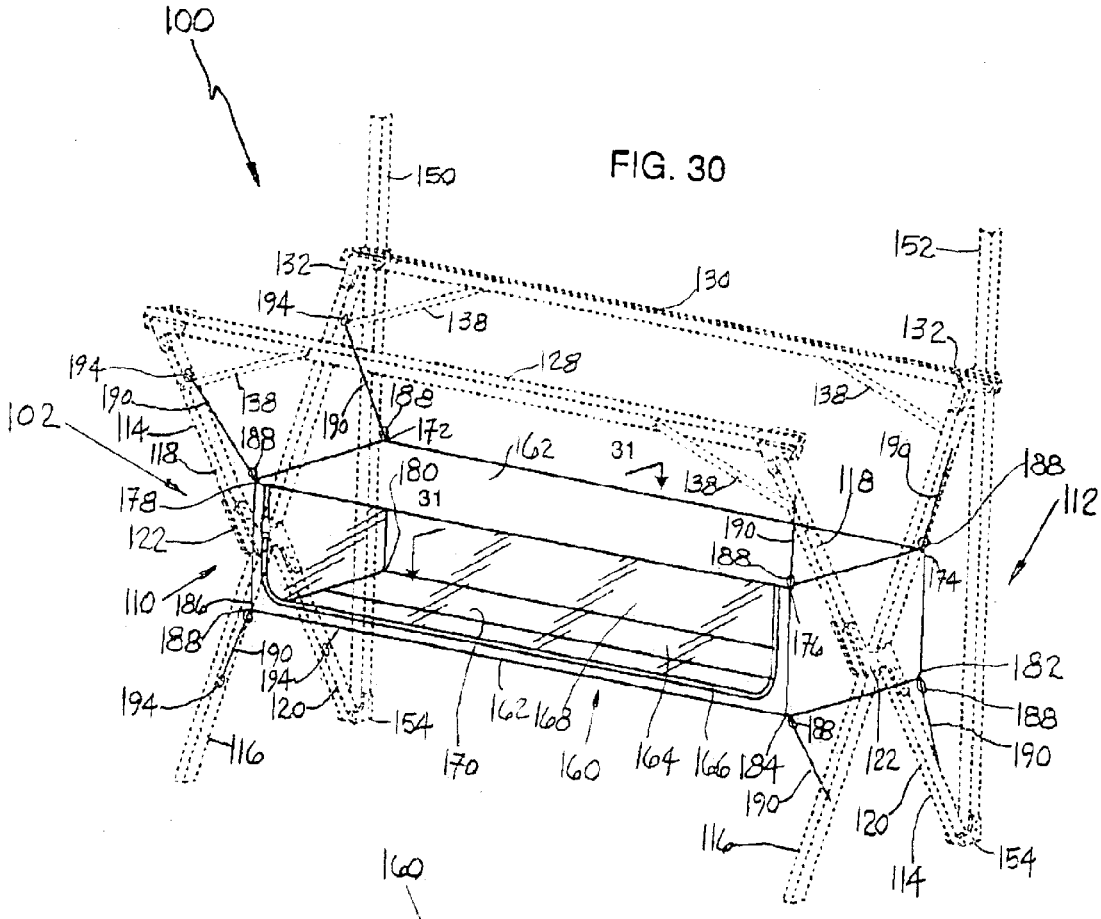
FIG. 30 is a perspective view of the portable modular field kitchen of FIG. 1 (shown in phantom) with the bag pantry suspended from the plurality of support leg sets of the main frame by a plurality of elastic lines.
Figure 31:
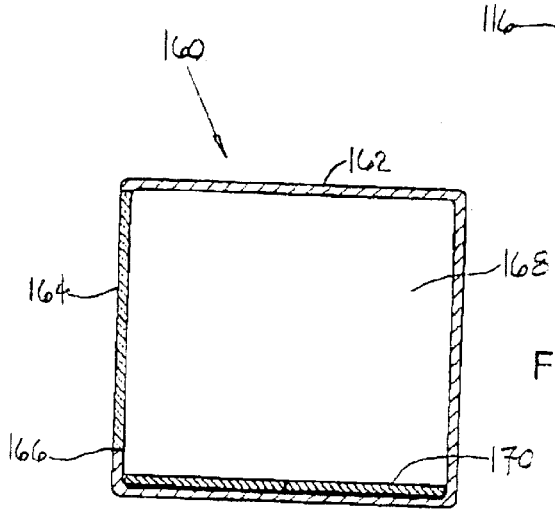
FIG. 31 is a cross-sectional view of the bag pantry of the portable modular field kitchen of FIG. 1 taken along the line 31—31 of FIG. 30 showing a folding floor and a clear plastic window.

In addition to the features already described, the main frame 102 also includes structure designed to securely attach a bag pantry 160 thereto as is clearly shown in FIGS. 1, 2, 30 and 31. The function of the bag pantry 160 is to store kitchen equipment used in the preparation of food. FIG. 1 shows the bag pantry 160 secured to the main frame 102 in a normal use position while FIG. 2 shows the bag pantry 160 exploded away from the main frame 102. FIG. 30 shows more clearly the method of attaching the bag pantry 160 to the main frame 102. The bag pantry 160 is comprised of a rectangular-shaped container 162 fashioned from, for example, plastic but could be comprised of other robust materials resistant to the elements such as canvas. The rectangular-shaped container 162 includes a clear plastic window 164 which is also generally rectangular in shape as is shown in FIGS. 1, 2 and 30. One side of the window 164 is sealed to the rectangular-shaped container 162 while the remaining three sides of the clear plastic window 164 are removably sealed to the rectangular-shaped container 162 via a mechanical zipper 166. The mechanical zipper 166 is attached to the rectangular-shaped container 162 and the window 164 by conventional means such as by stitching. Operation of the mechanical zipper 166 in a first direction opens the window 164 providing access to an interior 168 of the rectangular-shaped container 162 while operation of the zipper 166 in the opposite direction closes the clear plastic window 164. The bag pantry 160 includes a folding floor 170 comprised of heavy fiberboard, cardboard or the like as is shown in the cross-sectional view of FIG. 31. The floor 170 serves to provide a stiff bottom surface for the interior 168 of the rectangular-shaped container 162 so that, for example, pots and pans and heavier items can be stowed within the bag pantry 160. The floor 170 is designed to fold in half to accommodate storage upon disassembly of the bag pantry 160.

The bag pantry 160 is designed to be suspended from the main frame 102 and positioned underneath the removable top work surface 104. This positioning of the bag pantry 160 enables convenient use of the modular field kitchen 100. The rectangular-shaped container 162 is in the form of a parallelepiped having four top corners 172, 174, 176 and 178 and four bottom corners 180, 182, 184 and 186 as is best shown in FIG. 30. Sewn to each of the top corners 172, 174, 176 and 178 is one of a plurality of web loops 188 with one of a corresponding plurality of elastic lines 190 tied thereto. Located at the end of each of the elastic lines 190 is one of a plurality of S-shaped hooks 192 as shown in FIG. 2. Likewise, sewn to each of the bottom corners 180, 182, 184 and 186 is one of the web loops 188 with one of the corresponding elastic lines 190 tied thereto. Further, located at the end of each of the elastic lines 190 attached to the bottom corners 180, 182, 184 and 186 is one of the S-shaped hooks 192. The function of the S-shaped hooks 192 is to attach to one of a corresponding plurality of penetrations 194 formed in the main frame 102. The penetrations 194 are located as follows: two penetrations 194 are formed in the rear support leg 116 of both the first and second scissors support legs 110 and 112; one penetration 194 is formed in the first leg section 118 of the front support leg 114 of both the first and second scissors support legs 110 and 112; and one penetration 194 is formed in the second leg section 120 of the front support leg 114 of both the first and second scissors support legs 110 and 112. Attachment of the corresponding S-shaped hooks 192 into the corresponding penetrations 194 causes the bag pantry 160 to be suspended in a taunt manner as is shown in FIGS. 1, 2 and 30. It is noted that the bag pantry 160 can also be utilized as a convenient carrying container for transporting the modular field kitchen 100.

Figure 19:
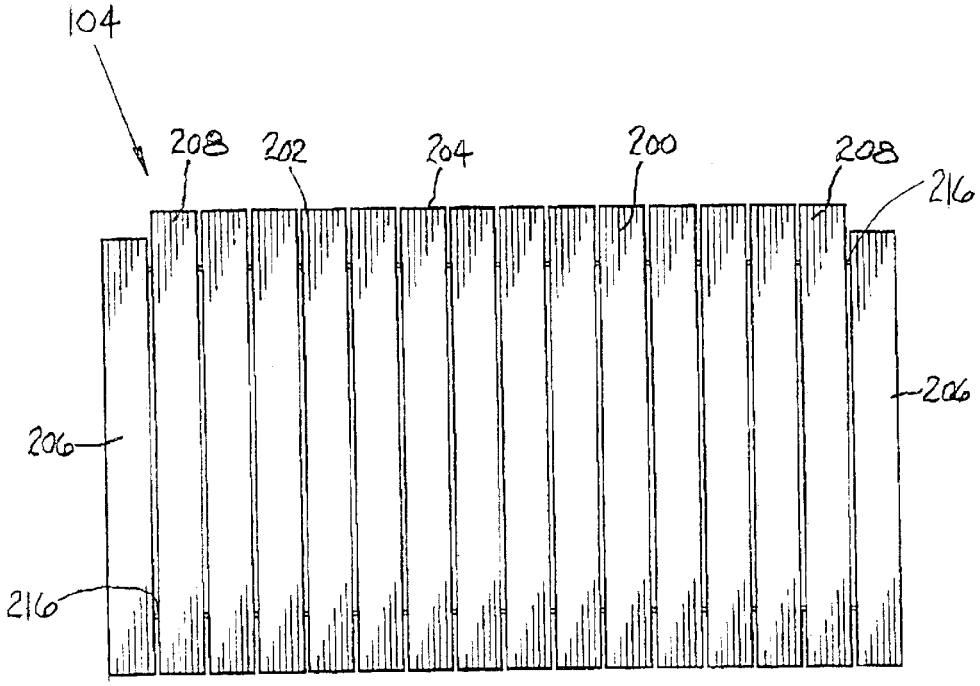
FIG. 19 is a top planar view of the removable top work surface of the portable modular field kitchen of FIG. 1 showing a plurality of slats held together by a pair of elastic cords.
Figure 20:
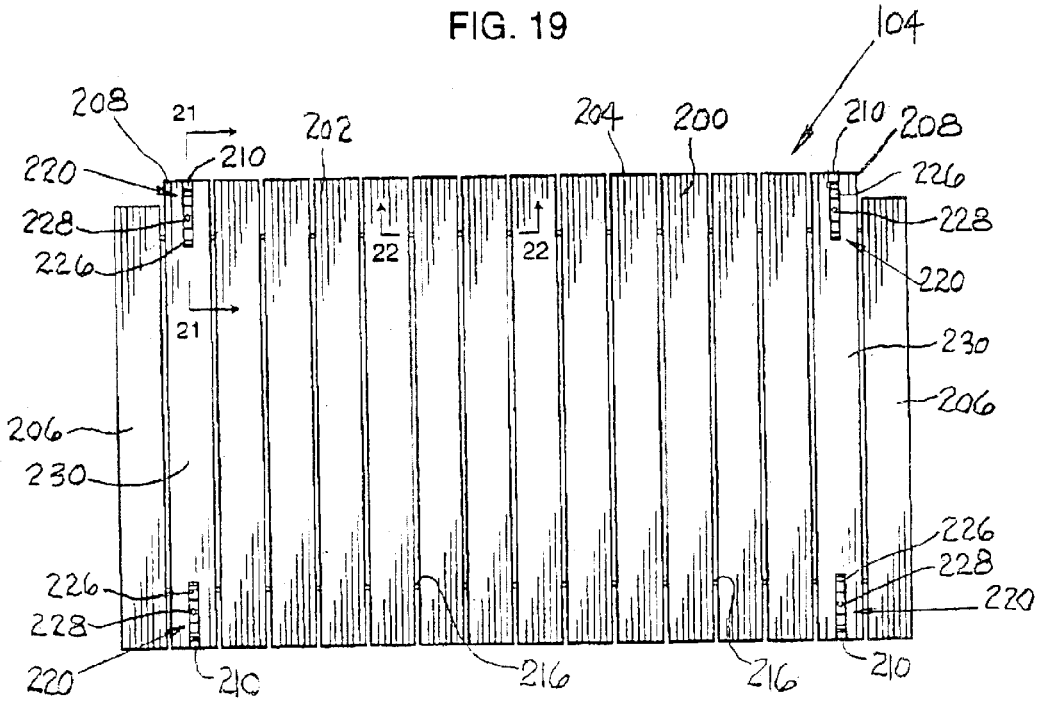
FIG. 20 is a bottom planar view of the removable top work surface of the portable modular field kitchen of FIG. 1 showing the plurality of slats held together by the pair of elastic cords, and four plastic retainer clips each having an alignment pin with two retainer clips mounted on each of two opposite next-to-the-end slats for attaching to the main frame.
Figure 21:
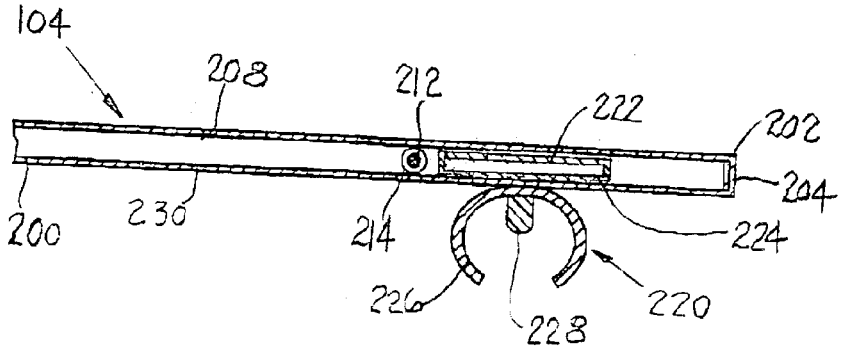
FIG. 21 is a cross-sectional view of the portable modular field kitchen of FIG. 1 taken along the line 21—21 of FIG. 20 showing the construction of one of the plastic retainer clips including the alignment pin for attaching the two opposite next-to-the-end slats to the main frame, and showing one of the pair of elastic cords.
Figure 22:
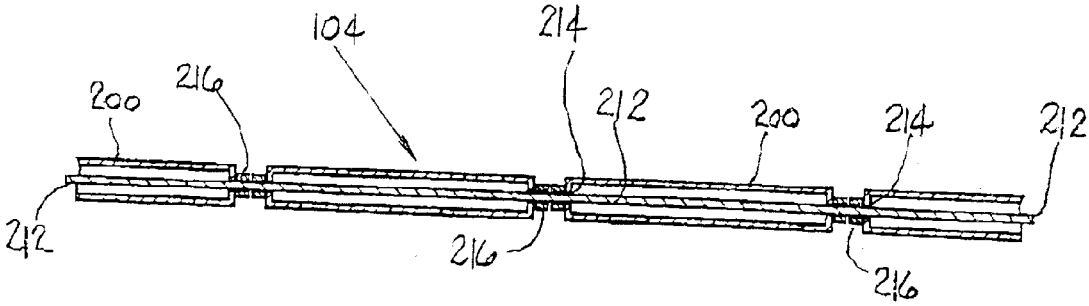
FIG. 22 is a cross-sectional view of the portable modular field kitchen of FIG. 1 taken along the line 22—22 of FIG. 20 showing the plurality of slats each separated by a pair of plastic spacers with the pair of elastic cords passing through the hollow interior of each slat and corresponding plastic spacers.

We now turn to the discussion of the second category of the preferred embodiment, i.e., the removable top work surface 104. The top work surface 104 is clearly shown in FIGS. 1, 2, 19 and 20 but portions of the top work surface 104 are also shown in FIGS. 12, 13, 21, 22, 23 and 24. The function of the top work surface 104 is to facilitate the preparation of food at the particular situs at which the modular field kitchen 100 is employed. In general, the top work surface 104 is removably mounted on the main frame 102 at approximately the standard counter top height above the ground level as is clearly shown in FIG. 1 and also shown exploded away in FIG. 2. The top work surface 104 is comprised of a plurality of hollow slats 200 typically comprised of extruded aluminum but could be fashioned from other suitable lightweight, high-strength materials such as plastic. Each hollow slat 200 is approximately (2–2½) inches wide, 25" in length and ½" in depth. Each of the ends 202 of each of the hollow slats 200 is closed off with a removable plastic cap 204 as shown in FIG. 21. Typically, there is sixteen slats 200 that comprise the entire removable top surface 104 as is shown in FIG. 1. Of the sixteen slats 200, a pair of end slats 206 are somewhat shorter in length, i.e., approximately 23½", since the end slats 206 interface with the first vertical upright member 150 and the second vertical upright member 152 as is clearly shown in FIGS. 1, 19 and 20. Further, a pair of "next-to-the-end" slats 208 clearly shown in FIGS. 19 and 20 (but also in FIGS. 23 and 24) each include a bore or groove 210 formed therein. The bore or groove 210 typically is formed by a router device for cutting the bore or groove 210 into the bottom of the pair of aluminum slats 208 as is best shown in FIG. 20. The function of the bore or groove 210 will be discussed herein below.

Figure 23:
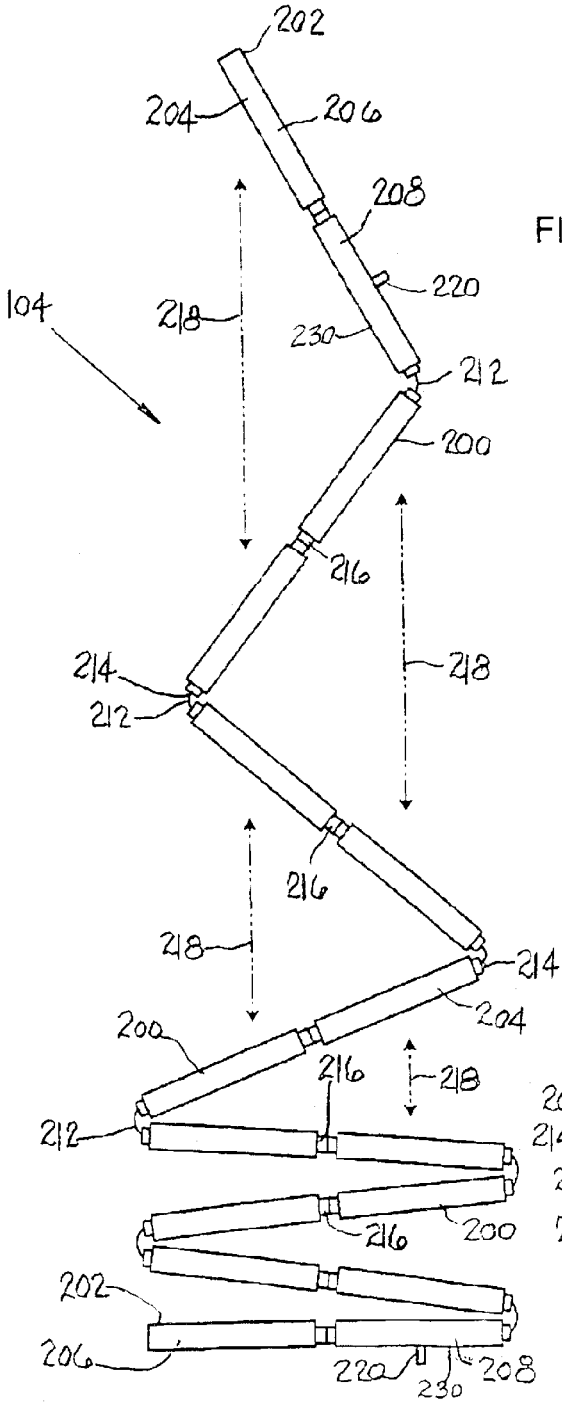
FIG. 23 is an elevation of the plurality of slats of the portable modular field kitchen of FIG. 1 illustrating the expanding and collapsing of the slats two at a time and separated by the plastic spacers with the plastic retainer clip shown affixed to each of the two opposite next-to-the-end slats.
Figure 24:
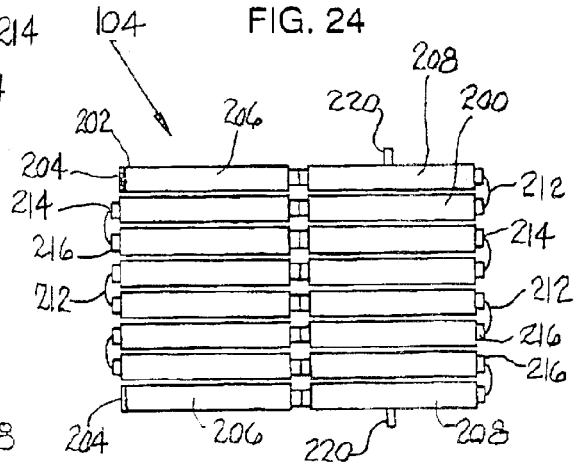
FIG. 24 is a front elevation of the plurality of slats of the portable modular field kitchen of FIG. 1 shown stacked two at a time with the plastic retainer clips shown affixed to each of the two opposite next-to-the-end slats.

Each of the hollow slats 200 is loosely held to each adjacent slat 200 typically by a pair of bungie cords 212, i.e., elastic cords, that are threaded through a plurality of holes 214 formed in each of the hollow slats 200 as is shown in FIGS. 19, 20, 22 and 23. The bungie cords 212 are tied off inside the end slats 206 so that the slats 200 can be separated from one another notwithstanding they are loosely held together by the bungie cords 212. It is the bungie cords 212 that keep the hollow slats 200 aligned when they are spread out onto the main frame 102 to form the removable top work surface 104 as is shown in FIG. 1. Each of the hollow slats 200 includes a plurality of donut spacers 216 mounted over the corresponding plurality of holes 214. The donut spacers 216 each include a center penetration (not shown) and serve to (a) separate each of the hollow slats 200 from the adjacent hollow slats 200, and also (b) as a guide for the bungie cords 212 through each of the corresponding hollow slats 200 as is shown in FIGS. 19, 20, 22 and 23. Each of the donut spacers 216 can be comprised of plastic, nylon or other rubberized material and can fit within dimples or depressions (not shown) formed in the sides of each of the hollow slats 200. It is noted that each of the end slats 206 includes two spacers 216 and the remainder of the intermediate hollow slats 200 include four spacers 216 as is best shown in FIGS. 23 and 24. When the top work surface 104 is removed from the top of the main frame 102, each of the hollow slats 200 threaded by the pair of bungie cords 212 can be conveniently rolled up in a manner reminiscent to that of an accordian instrument as is best shown in FIG. 24. Typically, the slats 200 are rolled or stacked in pairs as is shown in FIG. 23 to achieve the stacking posture shown in FIG. 24. When it is desired to place the top work surface 104 onto the main frame 102 of the modular field kitchen 100, the stack of hollow slats 200 is separated as is shown by the arrows 218 in FIG. 23 and repositioned as desired.

The removable top work surface 104 is mounted to the main frame 102. i.e., particularly to the first parallel top support member 128 and the second parallel top support member 130. A plurality of retainer clips 220 are employed to securely attach the plurality of hollow slats 200 of the top work surface 104 to the first and second parallel top support members 128 and 130 of the main frame 102. Each of the retainer clips 220 are typically comprised of plastic but can also be formed from brass, aluminum or other suitable material. The plastic retainer clip 220 is best shown in FIGS. 13, 20 and 21 with each including a box-shaped body 222 having dimensions somewhat smaller than the dimensions of each of the hollow slats 200 that form the top work surface 104. Thus, the box-shaped body 222 is sized such that it can be positioned within any of the hollow slats 200 as is best shown in FIGS. 13 and 21. Attached to a bottom side 224 of the box-shaped body 222 is a circular clip 226 which is typically integrally formed with the box-shaped body 222. The circular clip 226 serves to wrap about and grasp the eight-sided tubing that forms the first and second top support members 128 and 130, respectively. Additionally, extending from within the inner circumference of each of the circular clips 226 is an alignment pin 228 typically comprised of plastic as is shown clearly in FIGS. 12, 13, 20, 21, 23 and 24. The alignment pins 228 function to retain the top work surface 104 in the proper position on the main frame 102. Thus, when the top work surface 104 is properly positioned on the main frame 102, each of the alignment pins 228 is positioned in the corresponding penetration 148 formed in the eight-sided tubing of the first and second top support members 128 and 130, respectively, shown best in FIG. 3.

In practice, each of the plastic retainer clips 220 described above interfaces with only the pair of "next to the end" slats 208. Since there are only two "next to the end" slats 208 with two plastic retainer clips 220 per slat 208, there are only four plastic retainer clips 220 which are clearly shown in FIG. 20. Thus, the circular clip 226 and alignment pin 228 of two of the plastic retainer clips 220 are available for attaching to the eight-sided tubing of the first top support member 128. Likewise, the circular clip 226 and alignment pin 228 of the remaining two plastic retainer clips 220 are available for attaching to the eight-sided tubing of the second top support member 130. The four plastic retainer clips 220 are assembled to the pair of "next to the end" slats 208 in the following manner. Each of the hollow slats 200 includes the end 202 as is shown in FIGS. 19 and 20. The bore 210 is formed at the end 202 in a bottom side 230 of each of the "next to the end" slats 208 as is shown in FIG. 20. Since the box-shaped body 222 of each of the plastic retainer clips 220 has dimensions smaller than those of the "next to the end" slats 208, the box-shaped body 222 can be fitted within the slats 208 as is shown in FIGS. 13 and 21. Once the box-shaped body 222 is fitted within the slat 208, the circular clip 226 and the alignment pin 228 of the retainer clip 220 extend through the bore 210 formed in the bottom side 230 of each "next to the end" slat 208. The box-shaped body 222 of each retainer clip 220 is held in place inside the "next to the end" slats 208 by peening, i.e., striking the slat 208 with a suitable hammer to form a dimple or mechanical restraint in the aluminum. This action serves to hold the components of the retainer clip 220 and the "next to the end" slats 208 together without a mechanical fastener.

Thus, when each of the alignment pins 228 are inserted into the penetrations 148 formed in the first and second top support members 128 and 130, and each of the circular clips 226 are wrapped about the first and second top support members 128 and 130, respectively, the top work surface 104 is securely attached to the main frame 102. However, it is noted that the hollow slats 200 that are intermediate the pair of "next to the end" slats 208 are capable of limited movement since those slats 200 do not include one of the plastic retainer clips 220.

We now turn to the discussion of the third category of the preferred embodiment, i.e., the collapsible upper frame section 106 also referred to as the superstructure. The collapsible upper frame section 106 is clearly shown in FIGS. 1, 2 and 3 but portions of the upper frame section 106 are also shown in FIGS. 14–18 and 32–36. The function of the collapsible upper frame section 106 is to facilitate conveniently suspending cooking articles and lanterns above the removable top work surface 104 of the modular field kitchen 100 during the preparation of food. In general, the collapsible upper frame section 106 is mounted above the main frame 102 and the top work surface 104 as is clearly shown in FIG. 1 and also shown exploded away in FIG. 2. The collapsible upper frame section 106 comprises several main components including a first mid-vertical section 232 and a second mid-vertical section 234 each of which are supported by the corresponding first and second vertical upright members 150, 152, respectively, a cross arm 236, a first lantern holder 238 and a second lantern holder 240 best shown in FIGS. 1 and 2. Both of the first vertical upright member 150 and the second vertical upright member 152 are comprised of eight-sided hollow tubing (as are all of the tubular components of the main frame 102). Thus, the top ends 242 of the first and second upright members 150 and 152 are open, i.e., are designed to receive another compatible eight-sided tube of a smaller dimension as shown in FIG. 2.

The open top ends 242 of both the first and second vertical upright members 150 and 152, respectively, are clearly shown in FIG. 2. Mounted on the bottom of each of the first mid-vertical section 232 and the second mid-vertical section 234 is an extension piece 244. Each of the extension pieces 244 is dimensioned somewhat smaller than the dimensions of the eight-sided tubing of which the first and second vertical upright members 150 and 152 and the first and second mid-vertical sections 232 and 234 are comprised. The extension pieces 244 are mechanically restrained within the bottom of the first and second mid-vertical sections 232 and 234 as by peening, i.e., by creating a dimple in the eight-sided aluminum tubing to retain the corresponding extension piece 244 to the bottom portions of the first and second mid-vertical sections 232 and 234, respectively. The open top ends 242 of each of the first and second vertical upright members 150 and 152 serve as receptacles for the pair of extension pieces 244. The pair of extension pieces 244 extend into the open top ends 242 until the first and second mid-vertical sections 232 and 234 butt against the first and second vertical upright members 150 and 152, respectively. In this manner, the first and second vertical upright members 150 and 152 support the first and second mid-vertical sections 232 and 234.

Figure 14:
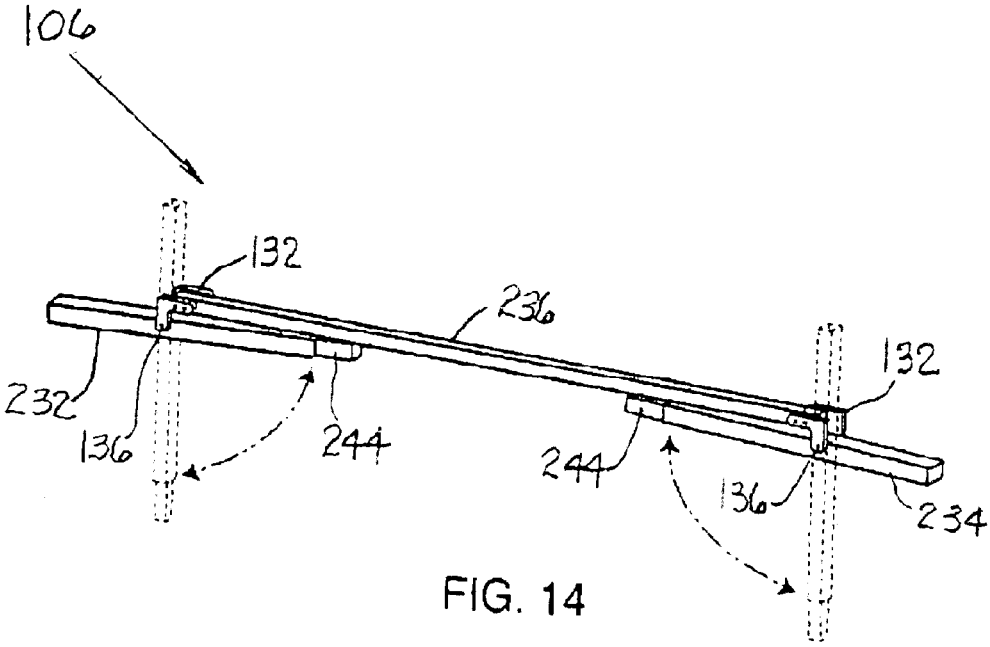
FIG. 14 is a perspective view of the cross arm connected by angle brackets to the pair of mid-vertical sections of the portable modular field kitchen of FIG. 1 with the mid-vertical sections shown moving between a vertical open position (in phantom) and a collapsed horizontal position.
Figure 15:
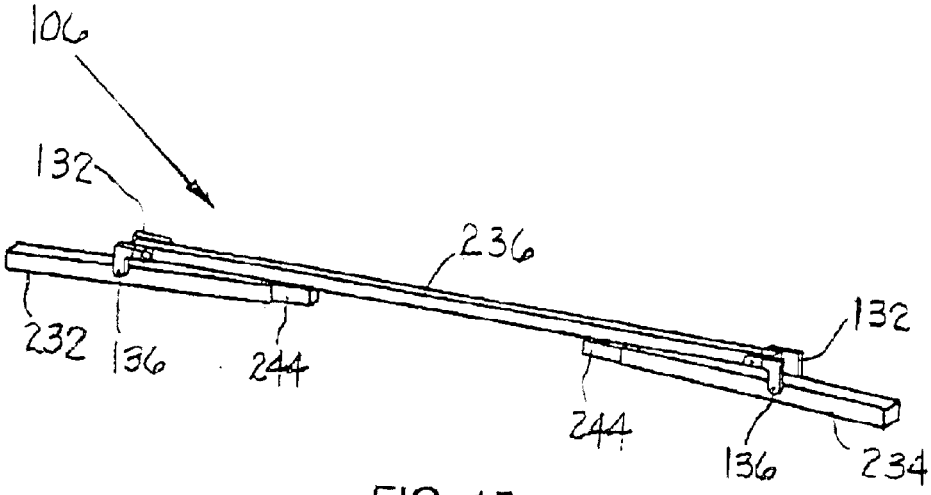
FIG. 15 is a perspective view of the cross arm connected by angle brackets to the pair of mid-vertical sections of the portable modular field kitchen of FIG. 1 with the mid-vertical sections shown in the collapsed horizontal position.

It is noted that the first mid-vertical section 232 and the second mid-vertical section 234 are connected by the cross arm 236 as is shown in FIG. 1 but more particularly in FIG. 2. FIG. 2 shows the first and second mid-vertical sections 232 and 234 connected by the cross arm 236 exploded away from the first and second vertical upright members 150 and 152. The cross arm 236 is connected to each of the first and second mid-vertical sections 232 and 234 via a pair of the plurality of angle brackets 132 that was previously described in connection with the first and second top support members 128 and 130 and main frame 102. Each of the angle brackets 132 is typically comprised of aluminum and includes a plurality of penetrations 134 (preferably three) for receiving an equal plurality of fasteners 136 such as, for example, rivets. The angle brackets 132 in this part of the invention in combination with the fasteners 136 are employed to rigidly retain the cross bar 236 to each of the first and second mid-vertical sections 232 and 234, respectively. It is noted that only one of the fasteners 136 (typically rivets) is positioned through each of the first and second mid-vertical sections 232 and 234. Consequently, each of the first and second mid-vertical sections 232 and 234 pivot about the fastener136 for facilitating the flat collapse of both mid-vertical sections 232 and 234 onto the cross bar 236 as shown in FIGS. 14 and 15. The rotating movement of both mid-vertical sections 232 and 234 is illustrated in FIG. 14 while the flat collapsed position is shown in FIG. 15.

Figure 35:
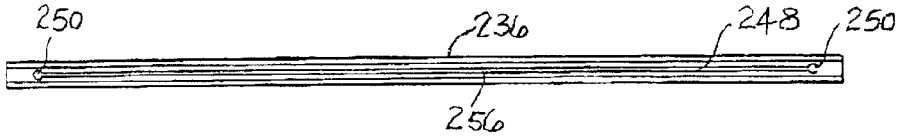
FIG. 35 is a bottom plan view of the cross arm supported between the mid-vertical sections of the portable modular field kitchen of FIG. 1 showing a raceway through which a plurality hooks are suspended and moved.
Figure 36:
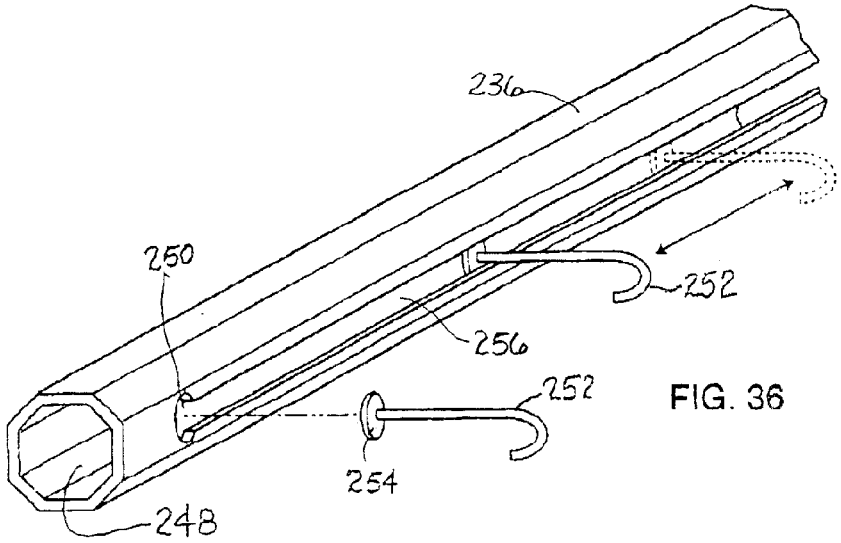
FIG. 36 is a perspective view of the cross arm supported between the mid-vertical sections of the portable modular field kitchen of FIG. 1 showing the raceway including an access opening through which the plurality of hooks are inserted, suspended and removed.

The cross arm 236 is shown in more detail in FIGS. 35 and 36. The cross arm 236 is comprised of the eight-sided aluminum tubing as previously described but includes a raceway 248 formed in the bottom of the cross arm 236. The raceway 248 includes a pair of access openings 250 as is shown best in FIG. 36. Extending outward from the raceway 248 is a plurality of hooks 252 where the hooks 252 are employed for hanging kitchen utensils and cooking articles therefrom as is best illustrated in FIGS. 1 and 3. Each of the hooks 252 includes a disk-shaped end 254 that is small enough to pass through one of the access openings 250 and thus enter the raceway 248 but large enough not to fall out of the raceway 248. Thus, the diameter of the disk-shaped end 254 of the hooks 252 is larger than the dimension of a slot 256 formed in the raceway 248. Based upon this design, each of the hooks 252 is capable of moving along the length of the raceway 248 where any of the hooks 252 can be inserted into or removed from one of the pair of access openings 250 as is clearly shown in FIGS. 35 and 36.

Figure 32:
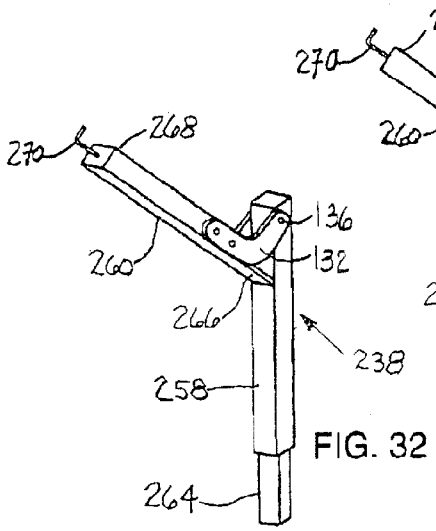
FIG. 32 is a perspective view of one of the pair of removable lantern holders having a rotating member pivotally attached to a fixed vertical member by a pair of angle brackets.
Figure 33:
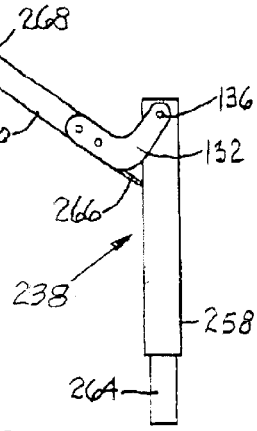
FIG. 33 is a side elevation of one of the pair of removable lantern holders showing the rotating member positioned to receive a lantern.
Figure 34:
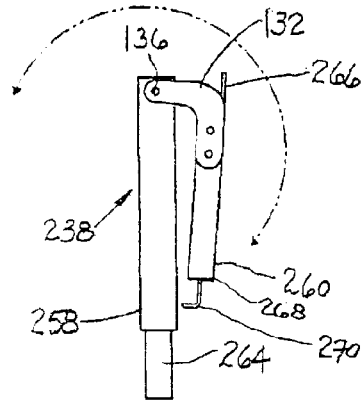
FIG. 34 is a side elevation of one of the pair of removable lantern holders showing the path of the rotating member between the extended position (in phantom) and the collapsed position.

The first lantern holder 238 and the second lantern holder 240 are mounted above the first mid-vertical section 232 and the second mid-vertical section 234, respectively, as shown in FIGS. 1, 2 and 3. Each of the lantern holders 238 and 240 serve to suspend lanterns (not shown) above the top work surface 104 and is comprised of a fixed vertical member 258 and a rotating member 260 as is shown in FIGS. 32, 33 and 34. The first and second lantern holders 238 and 240 are supported as follows. In a manner similar to the support provided by the first and second vertical upright members 150 and 152 to the first and second mid-vertical sections 232 and 234, each of the first and second mid-vertical sections 232 and 234 exhibits a top end 262 that is open, i.e., is designed to receive another compatible eight-sided tube of a smaller dimension as shown in FIG. 2. Mounted on the bottom of each of the fixed vertical members 258 of the first and second lantern holders 238 and 240 is an extension piece 264. Each of the extension pieces 264 is dimensioned somewhat smaller than the dimensions of the eight-sided tubing of which the first and second mid-vertical sections 232 and 234 and the first and second lantern holders 238 and 240 are comprised.

The extension pieces 264 are mechanically restrained within the bottom of the first and second lantern holders 238 and 240 as by peening, i.e., by creating a dimple in the eight-sided aluminum tubing to retain the corresponding extension piece 264 to the bottom portions of the first and second lantern holders 238 and 240, respectively. The open top ends 262 of each of the first and second mid-vertical sections 232 and 234 serve as receptacles for the pair of extension pieces 264. The pair of extension pieces 264 extend into the open top ends 262 until the first and second lantern holders 238 and 240 butt against the first and second mid-vertical sections 232 and 234, respectively. In this manner, the first and second mid-vertical sections 232 and 234 support the first and second lantern holders 238 and 240.

The remainder of the components of each of the first and second lantern holders 238 and 240 will now be described with reference to FIGS. 32, 33 and 34. The rotating member 260 is pivotally connected to the fixed vertical member 258 of each of the lantern holders 238 and 240 via a pair of the plurality of angle brackets 132 that were previously described in connection with the first and second mid-vertical sections 232 and 234 and the cross arm 236. Each of the angle brackets 132 is typically comprised of aluminum and includes a plurality of penetrations 134 (preferably three) for receiving an equal plurality of fasteners 136 such as, for example, rivets. The angle brackets 132 in this part of the invention in combination with the fasteners 136 are employed to rigidly retain the fixed vertical member 258 to the rotating member 260 of each of the first and second lantern holders 238 and 240, respectively. It is noted that only one of the fasteners 136 (typically rivets) is positioned through each of the fixed vertical members 258 of the first and second lantern holders 238 and 240. Consequently, each of the rotating members 260 pivot about the fastener 136 for facilitating the flat collapse of the rotating member 260 onto the fixed vertical member 258. The pivotal movement of the rotating member 260 of each of the first and second lantern holders 238 and 240 is illustrated in FIG. 34. Note that the rotating member 260 includes an angular extension 266 that seats against the fixed vertical member 258 as is best shown in FIGS. 32 and 33. The angular extension 266 causes the rotating member 260 of each of the first and second lantern holders 238 and 240 to be positioned at an angle less than ninety degrees when extended as is shown in FIG. 33. However, when the rotating member 260 is collapsed upon the fixed vertical member 258, the angular extension 266 does not interfere as is shown in FIG. 34. In addition, a terminal end 268 of each rotating member 260 includes a lantern hanging hook 270 as is clearly shown in FIGS. 1–3 and FIGS. 32–34.

Figure 16:
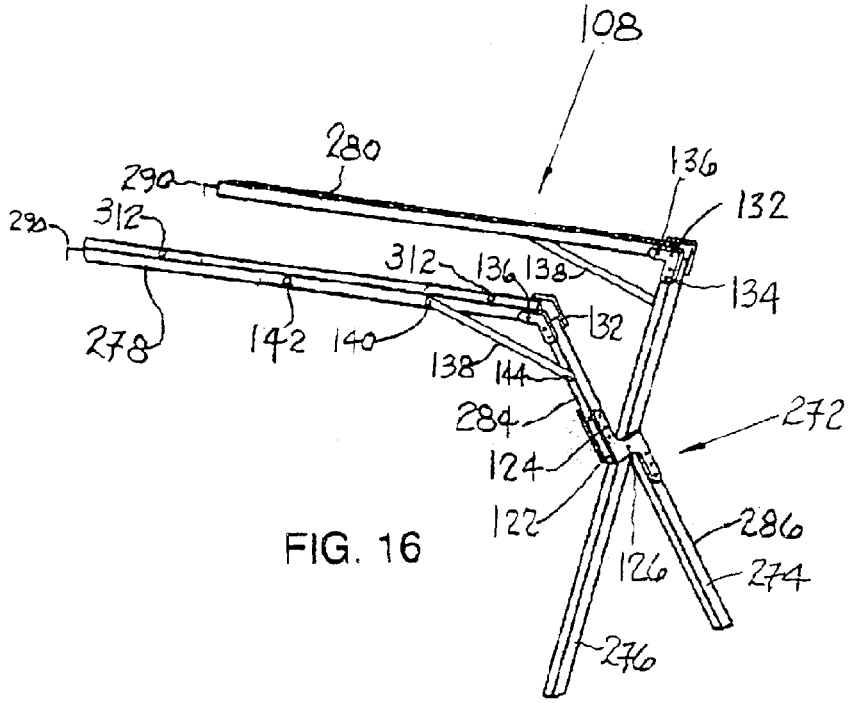
FIG. 16 is a perspective view of the auxiliary side table of the portable modular field kitchen of FIG. 1 showing a frame in the erect position including one of the plurality of offset hinges for facilitating a scissors action.
Figure 17:
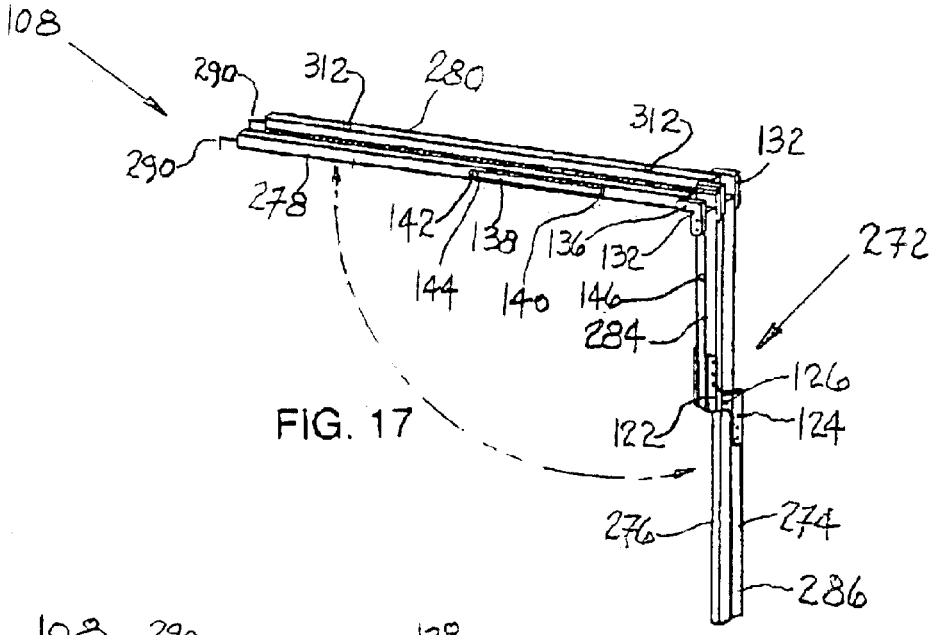
FIG. 17 is a perspective view of the frame of the auxiliary side table of the portable modular field kitchen of FIG. 1 shown in the partially collapsed position with the scissors action rotating about the offset hinge.
Figure 18:
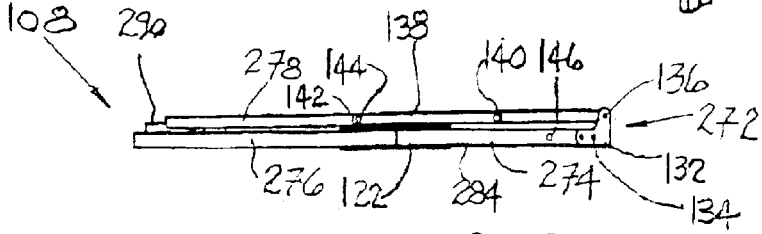
FIG. 18 is an elevation of the frame of the auxiliary side table of the portable modular field kitchen of FIG. 1 shown in the fully collapsed position.

We now turn to the discussion of the fourth category of the preferred embodiment, i.e., the auxiliary side grate table 108 attached to the main frame 102. The side grate table 108 is clearly shown in FIGS. 1 and 2 but portions of the side grate table 108 are also shown in FIGS. 16–18 and 25–29. The function of the side grate table 108 is to provide a table positioned above the ground level to conveniently facilitate the serving and eating of meals where the side grate table 108 is immediately adjacent to the removable top work surface 104 of the modular field kitchen 100. In general, the side grate table 108 is removably attached to the main frame 102 and positioned below the top work surface 104 as is clearly shown in FIG. 1. The side grate table 108 includes a construction somewhat similar to that of the main frame 102 as will now be described. The main components of the side grate table 108 include a collapsible frame 272 comprised of a first support leg 274 and a second support leg 276 as is best shown in FIGS. 16–18. Mounted above the first and second support legs 274 and 276 is a first parallel top support tube 278 and a second parallel top support tube 280 each of which is removably connected to the main frame 102. Also removably attached to the first and second parallel top support tubes 278 and 280 is a wire grate top surface 282 as is shown in FIGS. 25–29. The wire grate top surface 282 allows spilled food items to fall there through to the ground or floor level.

The collapsible frame 272 which is shown best in FIG. 16 will now be explained in more detail. The two main supporting components of the collapsible frame 272, i.e., the first support leg 274 and the second support leg 276, include a construction very similar to that of the first scissors support leg 110 and the second scissors support leg 112 (shown best in FIG. 3). Thus, the first support leg 274 is comprised of a first leg section 284 and a second leg section 286. The first leg section 284 is connected to the second leg section 286 with one of the pair of offset hinges 122 including the mechanical fasteners 124 and pivot fastener 126 (i.e., for example, rivets). As previously explained with respect to the main frame 102, use of the pair of offset hinges 122 enables the first support leg 274 to fold flat against the second support leg 276 to facilitate the initial collapsing of the frame 272 of the side grate table 108 as is clearly shown in FIG. 17.

The first parallel top support tube 278 is connected to the first leg section 284 of the first support leg 274 and the second parallel top support tube 280 is connected to the second support leg 276 via corresponding pairs of the angle brackets 132 as is shown clearly in FIGS. 16 and 17. Each of the angle brackets 132 is typically comprised of aluminum and includes the plurality of penetrations 134 (preferably three) for receiving the equal plurality of fasteners 136 such as, for example, rivets. The angle brackets 132 and the fasteners 136 are employed to rigidly retain (a) the first top support tube 278 to the first leg section 284 of the first support leg 274, and (b) the second top support tube 280 to the second support leg 276. Each of the fasteners 136 of angle brackets 132 are the only fasteners that pass through the first top support tube 278 and the second top support tube 280 and thus serve as a pivot. Since the fasteners 136 serve as a pivot, the first top support tube 278 and the second top support tube 280 can be folded or hinged toward the first support leg 274 and second support leg 276 of the collapsible frame 272 as shown by the arrow in FIG. 17. A complete collapse of the collapsible frame 272 is shown in FIG. 18.

The collapsible frame 272 also includes a pair of the plurality of support rods 138 for supporting the first and second parallel top support tubes 278 and 280 as is best shown in FIG. 16. The support rods 138 were initially described with reference to FIGS. 1–3 where each of the support rods 138 is hinged from one of a plurality of fasteners 140 such as, for example, rivets. Thus, each support rod 138 can be rotated from a non-engaged position to an engaged position located on one of the parallel top support tubes 278 or 280 as shown in FIGS. 16 and 17. When non-engaged, i.e., in a non-supporting position, each support rod 138 is rotated or pivoted from one of the fasteners 140 to one of a plurality of resting studs 142 best shown in FIGS. 16–18. The resting studs 142 are located on each of (1) the first parallel top support tube 278, and (2) the second parallel top support tube 280. Each of these locations correspond to one of the fasteners 140 as is shown in FIG. 16. Each of the support rods 138 includes a hook 144 located at the end thereof for attaching to the corresponding resting stud 142. When engaged, i.e., in a supporting position, each of the support rods 138 is rotated or pivoted from one of the fasteners 140 to one of a plurality of support studs 146 best shown in FIGS. 17–18. Two of the support studs 146 are located on each of (1) the first leg section 284 of the first support leg 274, and (2) on the second support leg 276 as is best shown in FIGS. 16 and 17. Once the hook 144 located on the end of each of the support rods 138 is attached to the corresponding support stud 146, the collapsible frame 272 of the side grate table 108 is reinforced. To disengage, each support rod 138 is merely removed from the corresponding support stud 146 located on one of the first support leg 274 or second support leg 276 and rotated or pivoted about the corresponding fastener 140 for repositioning on the corresponding resting stud 142.

The side grate table 108 is removably connected to the main frame 102 in the following manner. Referring to the second scissors support leg 112 shown best in FIG. 3 but also in FIGS. 4–8, a cylindrical receiver 288 is formed on (1) the first leg section 118 of the first support leg 114, and on (2) the rear support leg 116. The cylindrical receivers 288 are typically open at the top and bottom ends and can be formed integrally with the aluminum main frame 102. In the alternative, the cylindrical receivers 288 can be fused to the aluminum main frame 102 by any suitable method including the use of heat. Located on the end of each of the first parallel top support tube 278 and the second parallel top support tube 280 of the collapsible frame 272 of the side grate table 108 is an attachment means 290 such as, for example, a hook as is shown in FIGS. 16 and 17. When it is desired to attach the side grate table 108 to the main frame 102, the hook attachment means 290 of the side grate table 108 is positioned in the cylindrical receiver 288 formed on the second scissors support leg 112. The support rods 138 are then engaged to provide support so that the side grate table 108 is now stable and ready for use. To disconnect the side grate table 108 from the main frame 102, the support rods 138 are disengaged and the hook attachment means 290 is removed from the cylindrical receiver 288. The side grate table 108 can then be collapsed for storage as shown in FIG. 18.

Figures 25, 26:
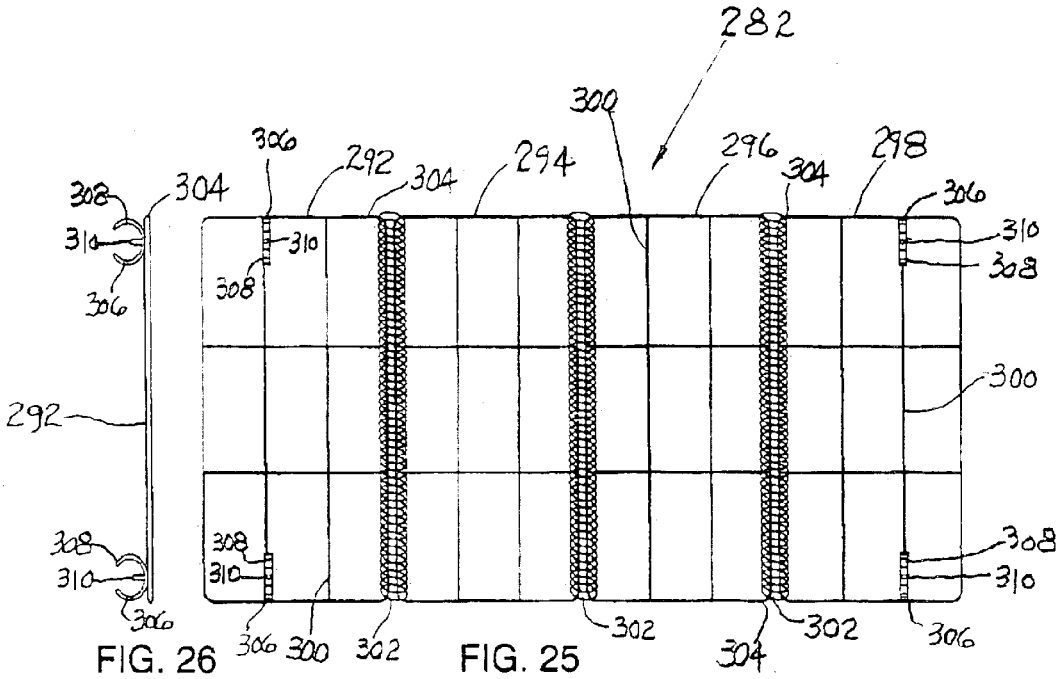
FIG. 25 is a bottom plan view of the wire grate top surface of the side table of the portable modular field kitchen of FIG. 1 showing a plurality of spiral connectors for holding together separate sections of the wire grate top surface, and showing a plurality of plastic retainer clips for attaching to a frame of the side table.
FIG. 26 is a right side elevation of the wire grate top surface of the side table of FIG. 25 showing two of the plastic retainer clips each having an alignment pin.
Figure 27:
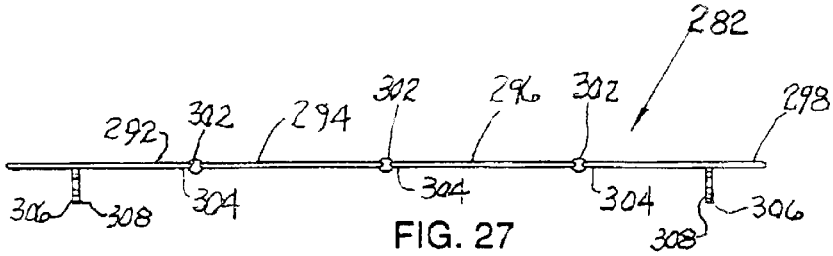
FIG. 27 is a front elevation of the wire grate top surface of the side table of FIG. 25 showing three spiral connectors for holding together separate sections of the wire grate top surface, and showing two plastic retainer clips.
Figure 28:
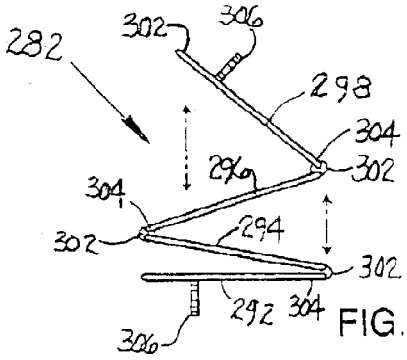
FIG. 28 is an end view of the wire grate top surface shown in the partially collapsed position indicated by the double-headed arrow, and a pair of the plastic retainer clips for attaching to the frame of the side table.
Figure 29:
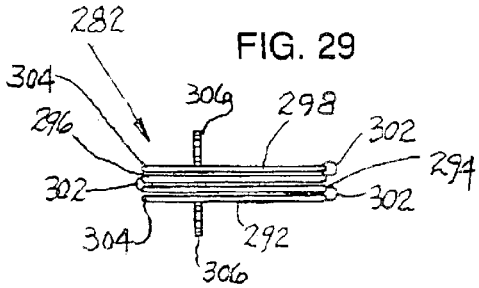
FIG. 29 is an end view of the wire grate top surface shown in the fully collapsed position including the pair of plastic retainer clips for attaching to the frame of the side table.

A description of the wire grate top surface 282 as shown in FIGS. 25–29 and how it is attached to the collapsible frame 272 will now be provided. The wire grate top surface 282 is comprised of a plurality of wire grate sections 292, 294, 296 and 298 as is best shown in FIG. 25. Each of the wire grate sections 292, 294, 296 and 298 are comprised of a lattice structure 300 typically fashioned from any suitable metal such as for example, rigid wire. The four wire grate sections 292, 294, 296 and 296 are identical in construction except that the pair of end wire grate sections 292 and 298 include a means for attaching the wire grate top surface 282 to the collapsible frame 272 as will be discussed in more detail herein below. Each of the wire grate sections 292, 294, 296 and 298 is physically connected to the adjacent wire grate section via one of a plurality of spiral connectors 302 as is best shown in FIG. 25. Each of the spiral connectors 302 are designed to connect a perimeter wire 304 of the lattice structure 300 of the adjacent wire grate sections so that each of the adjacent wire sections 292, 294, 296 and 298 are movable with respect to one another. Since each wire grate section 292, 294, 296 and 298 is movable with respect to one another, the wire grate sections 292, 294, 296 and 298 are collapsible and foldable for convenient storage and portability as is shown in the sequence of FIGS. 27, 28 and 29.

The pair of end wire grate sections 292 and 298 include a means for attaching the wire grate top surface 282 to the collapsible frame 272 as is shown in FIGS. 25–29. The means for attachment includes at least four of a plurality of retainer clips 306 (very similar to the retainer clips 220 initially introduced and previously discussed with reference to the removable top work surface 104 shown in FIGS. 13, 20 and 21). Each of the retainer clips 306 may be comprised of plastic but can also be formed from brass, aluminum or other suitable material. As used in conjunction with the end wire grate sections 292 and 298, the retainer clips 306 are typically attached to a suitable location on the lattice structure 300 as is shown in FIG. 25. The retainer clips 306 are positioned on the lattice structure 300 of wire grate sections 292 and 298 so as to interface with the first and second parallel top support tubes 298 and 280 as is shown in FIG. 2. The retainer clips 306 are affixed to the lattice structure 300 by any suitable method such as, for example, by the use of clamps or by heat fusing (where the retainer clips 306 are fashioned from metal such as brass or aluminum).

Each of the retainer clips 306 includes a circular clip 308 for wrapping about the first and second parallel top support tubes 278 and 280 as is shown in FIG. 16. Further, each retainer clip 306 also includes an alignment pin 310 extending downward from within the circumference of the circular clip 308 as is best shown in FIG. 26. Each of the alignment pins 310 is received by a penetration 312 formed within the top of the eight-sided tubing that forms the first parallel top support tube 278 and the second parallel top support tube 280 shown in FIGS. 16 and 17. Once the circular clip 308 is engaged and the alignment pins 310 are inserted into the penetrations 312 of the first parallel top support tube 278 and the second parallel top support tube 280, the wire grate top surface 282 is secured to the collapsible frame 272. By reversing this procedure, the wire grate top surface 282 can be removed from the side grate table 108 and folded for storage as is shown in FIGS. 27, 28 and 29.

The present invention provides novel advantages over other portable modular field kitchens known in the art. The main advantage of the modular field kitchen 100 of the present invention is that the entire structure can be disassembled and collapsed and deposited with a carrying case for convenient portability. For example, the main frame 102 is shown as collapsible in FIGS. 3–11, the top work surface 104 is shown removable and collapsed in FIGS. 23 and 24, the bag pantry 160 is shown removable in FIG. 2, the collapsible upper frame section 106 is shown collapsed in FIGS. 14–15 and FIGS. 32–36, and finally the side grate table 108 is shown disassembled and collapsed in FIGS. 16–18 and in FIGS. 25–29. Further, the entire modular field kitchen 100 is comprised of lightweight aluminum, is hardy and robust, and can be deposited into a carrying case, i.e., for example, the bag pantry 160 for convenient transport to a suitable venue for use.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

What is claimed is:

1. A portable modular field kitchen comprising:

a main frame having at least a pair of scissors support legs interconnected with at least a pair of vertical upright members for providing a scissors operator, each of said scissors support legs comprising a front support leg and a rear support leg interconnected to provide a scissors action, said scissors support legs being directly connected by a pair of parallel top support members for providing stability, and each of said vertical upright members being pivotally joined to said corresponding front support leg;

a top work surface removably attached to each of said parallel top support members for providing a food preparation surface, said top work surface comprised of a plurality of slats each separated by a plurality of spacers and connected together by at least one elastic cord;

a collapsible upper frame section supported by said vertical upright members for suspending a plurality of cooking articles above said top work surface; and at least one side grate table having a collapsible frame and being releasably attached to said main frame.

2. The portable modular field kitchen of claim 1 wherein said front support leg comprises a first leg section connected to a second leg section and to said rear support leg with a pair of offset hinges for enabling said front support leg to fold flat onto said rear support leg.

3. The portable modular field kitchen of claim 1 wherein each of said scissors support legs is interconnected by said parallel top support members with a plurality of angle brackets.

4. The portable modular field kitchen of claim 1 wherein each of said vertical upright members is connected to a corresponding one of said parallel top support members with a guide bracket.

5. The portable modular field kitchen of claim 1 wherein each of said scissors support legs and each of said corresponding vertical upright members collapse and fold onto said parallel top support members.

6. The portable modular field kitchen of claim 1 wherein said top work surface is removably attached to said parallel top support members with a plurality of retainer clips.

7. The portable modular field kitchen of claim 1 wherein said main frame, said top work surface, and said upper frame section are each comprised of aluminum.

8. The portable modular field kitchen of claim 1 wherein said upper frame section comprises a cross arm having a plurality of hooks for suspending said cooking articles.

9. The portable modular field kitchen of claim 1 wherein said upper frame section further includes a pair of lantern holders, each of said lantern holders including a rotating member and an angular extension for positioning a lantern over said top work surface.

10. The portable modular field kitchen of claim 1 wherein said side grate table comprises a plurality of attachment hooks which are releasably attached to a corresponding plurality of cylindrical receivers on said scissors support legs of said main frame.

11. The portable modular field kitchen of claim 1 wherein said collapsible frame of said side grate table comprises a first support member and a second support member interconnected to provide a scissors action with each of said first support member and said second support member connected to a corresponding one of a pair of parallel top support tubes.

12. The portable modular field kitchen of claim 1 further including a bag pantry suspended by elastic lines from said main frame for storing said kitchen articles when not in use.

13. The portable modular field kitchen of claim 12 wherein said bag pantry further includes a clear plastic window.

14. A portable modular field kitchen comprising:

a main frame having at least a pair of scissors support legs interconnected with at least a pair of vertical upright members for providing a scissors operator, each of said scissors support legs comprising a front support leg and a rear support leg interconnected to provide a scissors action including a pair of offset hinges for enabling said front support leg to fold flat onto said rear support leg, said scissors support legs being directly connected by a pair of parallel top support members for providing stability, and each of said vertical upright members being pivotally joined to said corresponding front support leg;

a top work surface removably attached to each of said parallel top support members with a plurality of retainer clips each having an alignment pin for extending into one of a plurality of penetrations formed in said top support members for providing a food preparation surface; and a collapsible upper frame section supported by said vertical upright members for suspending a plurality of cooking articles above said top work surface.

15. The portable modular field kitchen of claim 14 wherein said collapsible upper frame section comprises a cross arm having a plurality of hooks for suspending said cooking articles.

16. The portable modular field kitchen of claim 15, wherein said cross arm further includes a raceway with an access opening for installing and removing said hooks for suspending said cooking articles.

17. A portable modular field kitchen comprising:

a main frame having at least a pair of scissors support legs interconnected with at least a pair of vertical upright members for providing a scissors operator, each of said scissors support legs comprising a front support leg and a rear support leg interconnected to provide a scissors action, said scissors support legs being directly connected by a pair of parallel top support members for providing stability, and each of said vertical upright members being pivotally joined to said corresponding front support leg, and each of said scissors support legs and each of said corresponding vertical upright members collapse and fold onto said parallel top support members;

a top work surface removably attached to each of said parallel top support members for providing a food preparation surface, said top work surface comprised of a plurality of slats each separated by a plurality of spacers and connected together by at least one elastic cord; and at least one side grate table having a collapsible frame releasably attached to said main frame, and a removable wire grate top surface attachable to said collapsible frame by a plurality of retainer clips.

18. The portable modular field kitchen of claim 17 wherein said removable wire grate top surface is comprised of a plurality of sections connected together by a plurality of spiral connectors.

19. The portable modular field kitchen of claim 17 wherein said removable wire grate top surface is foldable.

* * * * *